US009728060B2

(12) United States Patent
Ishii et al.

(10) Patent No.: US 9,728,060 B2
(45) Date of Patent: Aug. 8, 2017

(54) MONITORING SYSTEM

(71) Applicant: Hitachi, Ltd., Chiyoda-ku, Tokyo (JP)

(72) Inventors: Tomoyuki Ishii, Tokyo (JP); Tatsuo Nakagawa, Tokyo (JP); Masayoshi Ishibashi, Tokyo (JP); Midori Kato, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 35 days.

(21) Appl. No.: 14/762,419

(22) PCT Filed: Feb. 26, 2013

(86) PCT No.: PCT/JP2013/054976

§ 371 (c)(1),
(2) Date: Jul. 21, 2015

(87) PCT Pub. No.: WO2014/132340

PCT Pub. Date: Sep. 4, 2014

(65) Prior Publication Data

US 2015/0356849 A1 Dec. 10, 2015

(51) Int. Cl.
*G08B 23/00* (2006.01)
*G08B 21/04* (2006.01)

(52) U.S. Cl.
CPC ..... *G08B 21/0438* (2013.01); *G08B 21/0423* (2013.01)

(58) Field of Classification Search
CPC ..... G08B 21/0446; G08B 21/0438; G08B 21/0407; G08B 7/066; G08B 25/016; G08B 25/08
USPC ..... 340/573.1
See application file for complete search history.

(56) References Cited

U.S. PATENT DOCUMENTS

| | | | | |
|---|---|---|---|---|
| 7,916,066 | B1 | 3/2011 | Osterweil | |
| 2004/0240627 | A1 | 12/2004 | Nakajima | |
| 2005/0125403 | A1* | 6/2005 | Wakabayashi ..... | G08B 21/0423 |
| 2005/0131736 | A1* | 6/2005 | Nelson ..... | G06Q 50/22 705/2 |
| 2005/0181771 | A1* | 8/2005 | Cuddihy ..... | G08B 21/0492 455/414.1 |
| 2006/0055543 | A1* | 3/2006 | Ganesh ..... | G08B 21/0423 340/573.1 |

(Continued)

FOREIGN PATENT DOCUMENTS

| | | | |
|---|---|---|---|
| CN | 101024464 | A | 8/2007 |
| CN | 102387345 | A | 3/2012 |

(Continued)

OTHER PUBLICATIONS

International Search Report (PCT/ISA/210) dated May 21, 2013, with English translation (Twelve (12) pages).

(Continued)

*Primary Examiner* — Tai Nguyen
(74) *Attorney, Agent, or Firm* — Crowell & Moring LLP

(57) ABSTRACT

The present invention is a system for monitoring a health state of a subject. The system is provided with: a measuring unit that chronologically measures the position of the subject in a facility in which the subject resides or stays; and an information processing unit that determines a health state of the subject by determining whether a chronological change in the position of the subject satisfies a predetermined determination condition.

14 Claims, 21 Drawing Sheets

(56) References Cited

U.S. PATENT DOCUMENTS

| | | | | |
|---|---|---|---|---|
| 2010/0262045 | A1* | 10/2010 | Heaton | A61B 5/1112 600/595 |
| 2012/0116252 | A1 | 5/2012 | Newman et al. | |

FOREIGN PATENT DOCUMENTS

| | | | |
|---|---|---|---|
| EP | 2 418 849 | A1 | 2/2012 |
| GB | 2 344 167 | A | 5/2000 |
| GB | 2 482 396 | A | 2/2012 |
| JP | 2003-242569 | A | 8/2003 |
| JP | 2011-237865 | A | 11/2011 |
| JP | 2012-181631 | A | 9/2012 |
| WO | WO 2012/115881 | A1 | 8/2012 |

OTHER PUBLICATIONS

Shoji, "Footstep Localization with Microphone Array", IEICE Technical Report EA, Oyo Onkyo, 109(286), The Institute of Electronics, Information and Communication Engineers, 2009, pp. 61-66, with English-language Abstract (Eight (8) pages).

Kobayashi, et al., "A Blind Source Localization by Using Freely Positioned Microphones", The Transactions of the Institute of Electronics, Information and Communication Engineers A, Kiso Kyokai, J86-A(6), The Institute of Electronics, Information and Communication Engineers, 2003, pp. 619-627, with Partial English Translation, (Thirteen (13) pages).

Chinese-language Office Action issued in counterpart Chinese Application No. 201380071591.5 dated Jul. 5, 2016 (Four (4) pages).

Extended European Search Report issued in counterpart European Application No. 13876434.5 dated Sep. 1, 2016 (3 pages).

* cited by examiner

FIG. 8

| # | Time | Position (m) | Sound intensity | Sound frequency |
|---|---|---|---|---|
| 001 | 10:05:10.55 | 0.65 | 1.2 | Low |
| 002 | 10:05:11.21 | 1.20 | 1.4 | Low |
| 003 | 10:05:11.92 | 1.85 | 1.1 | Low |
| | | | | |

FIG. 14D
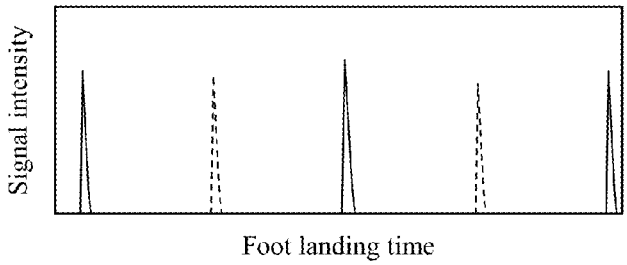
FIG. 14E
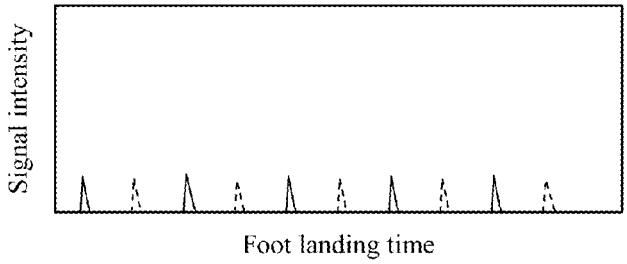
FIG. 15
Example of layout table
1500
| 1501 Layout ID | 1502 Category | 1503 Exit/Entry center position | 1504 Position determination minimum value | 1505 Position determination maximum value |
|---|---|---|---|---|
| R1 | C1 (Entrance) | 0 | | 0.45 |
| R2 | C4 (Toilet room) | 0.9 | 0.45 | 1.2 |
| R3 | C2 (Bathroom) | 1.5 | 1.2 | 2.0 |
| R4 | C3 (Living room) | 2.5 | 2.0 | 2.75 |
| R5 | C3 (Living room) | 3 | 2.75 | |
| R6 | C0 (Hallway) | - | - | - |

FIG. 16A

Example of state information table

1600

| 1601 State ID | 1602 Location | 1603 State start time/date | 1604 Continuation time (min) | 1605 Abnormality determination | 1606 Contact ID | 1607 Contact date/time |
|---|---|---|---|---|---|---|
| 1 | R1 (Entrance) | 1209 10:00 | 152 | | | |
| 2 | R2 (Toilet room) | 1209 12:32 | 3 | | | |
| 3 | R5 (Living room) | 1209 12:35 | 55 | U2 | T1 | 1209 16:05 |
| 4 | R4 (Living room) | 1209 | 120 | | | |

⋮

FIG. 16B

Example of contact content table

1610

| 1611 Contact ID | 1612 Content |
|---|---|
| T1 | Telephone subject; no abnormality |
| T2 | Telephone subject, then introduce to walk function training |
| T3 | Visit; no abnormality |
| T4 | Visit; abnormality, emergency response personnel contacted |

⋮

FIG. 17

Example of abnormality determination table

1700

| 1701 Abnormality ID | 1702 Meaning | 1703 Condition | 1704 Emergency |
|---|---|---|---|
| U1 | Go to toilet room at night many times | >= Toilet 3 times & night | 0 |
| U2 | Low walking speed | Walking speed < 0.8m/s | 0 |
| U3 | Back and forth many times | >10 times/1hr | 0 |
| U4 | Back and forth few times | <8 times/day | 0 |
| U5 | Shuffling tendency | | 0 |
| U6 | Long time in toilet | >45min | 1 |
| U7 | Long time in bath | >1.5hr | 1 |
| U8 | Not awake in morning | Not out of bedroom until 11:00 | 1 |
| U9 | Shuffling leg | | 0 |
| U10 | Rapid change in walking speed | Walking speed < 50% speed of month average | 0 |

⋮

MONITORING SYSTEM

TECHNICAL FIELD

The present invention relates to a personal state monitoring system.

BACKGROUND ART

In a society with aging population where fewer people of different generations live together, there are increasing risks of people failing to notice deterioration in the health of the elderly living alone or with no one of younger generations in the household, or a degradation in their living functions. Thus, a need exists for a system for efficiently monitoring the condition of residents.

Conventionally, resident monitoring systems are known including devices that monitor the state of utilization of pots, gas, water, electricity and the like; devices that detect passage of someone in front of a sensor installed in the house; and devices that allow a resident to alert people by pushing a button in case of emergency. These devices commonly monitor well-being by issuing notifications to the outside should abnormality develops.

Meanwhile, the elderly may fall and become unable to move, or encounter events requiring emergency care. In these cases, it is often difficult to expect their complete recovery even if treated properly, forcing the person bedridden or in need of nursing care. Thus, in order for the elderly to live an independent life longer, it is desirable to detect signs of deterioration in health or degradation of living functions and to take preventive action, rather than issuing alerts after abnormality has occurred. The conventional monitoring devices, however, do not include such function.

As a monitoring technology for estimating behaviors in everyday life, Patent Literature 1 discloses a subject monitoring system that monitors sounds using a sound sensor device. Patent Literature 1 also discloses a technology that estimates the location of a room in which sound was generated based on an intensity ratio of sounds picked up by a plurality of sound sensors, and that then estimates the cause of the sounds as well as their features.

CITATION LIST

Patent Literature

Patent Literature 1: JP 2011-237865 A

Non Patent Literature

Non Patent Literature 1: "Concept of Science and Society in the Age of Long Life", Hiroko Akiyama, Iwanami Shoten Publishers, Science Vol. 80, No. 1 (2010)

SUMMARY OF INVENTION

Technical Problem

In the conventional technology according to Patent Literature 1, the cause of an incident (such as a fall) is estimated from the position of the sound source and the magnitude of sound. However, the technology cannot detect deterioration in health and the like from a change in everyday condition (chronological change in condition) of the resident.

The present invention provides a system that chronologically evaluates a resident's condition without making the resident particularly conscious in his or her everyday life, and that determines the resident's health state.

Solution to Problem

In order to solve the problem, the configurations set forth in the claims are adopted, for example. While the present application includes a plurality of means for solving the problem, one example is a system for monitoring a health state of a subject, the system including a measuring unit that chronologically measures a position of the subject in a facility in which the subject resides or stays; and an information processing unit that determines the health state of the subject by determining whether a chronological change in the position of the subject satisfies a predetermined determination condition.

Advantageous Effects of Invention

According to the present invention, the position of the monitoring subject is chronologically measured and monitored, whereby a change in the daily life pattern of the monitoring subject can be sensed in everyday life. Thus, the health state of the monitoring subject can be learned.

Other features of the present invention will become apparent from the following description in the present specification and the attached drawings. Problems, configurations, and effects other than those described above will become apparent from the following description of embodiments.

BRIEF DESCRIPTION OF DRAWINGS

FIG. 8 shows an example of data set transmitted from the facility to an information processing system via a network.

FIG. 14D shows an example of chronological change in signal intensity when a foot lands on ground.

FIG. 14E shows an example of chronological change in signal intensity when a foot lands on ground.

FIG. 15 shows an example of a layout table.

FIG. 16A shows an example of a state information table.

FIG. 16B shows an example of a contact content table.

FIG. 17 shows an example of an abnormality determination table.

DESCRIPTION OF EMBODIMENTS

In the following, embodiments of the present embodiment will be described with reference to the attached drawing. While the attached drawings illustrate specific embodiments in accordance with the principle of the present invention, these are for facilitating an understanding of the present invention and are not to be taken to interpret the present invention in a limited sense.

A monitoring system of the present invention is characterized in that the position of a monitoring subject is chronologically measured to monitor the state of the monitoring subject. As another feature, the monitoring system of the present invention is provided with the function of monitoring the walking function of the monitoring subject. The walking function is monitored for the following reasons.

In Non Patent Literature 1, there is described an investigation result that a large proportion of the people who come to require care do so through the weakening of motor function or cognitive function. Thus, a monitoring system capable of monitoring motor function on a daily basis would be highly useful. Particularly, walking function is important in the sense of both enabling one to independently move and conduct living activities, and improving blood flow by walking exercise and maintaining metabolic function. Accordingly, a monitoring system for monitoring walking function on a daily basis would be effective. However, the current evaluation of motor function or walking function involves merely going to a gymnasium and the like for a municipality-sponsored functional evaluations once a year or so, for example. This is insufficient from the viewpoint of the range of coverage as well as the frequency of evaluation. In order to detect signs of deterioration in health or degradation in living functions and to take preventive action, it is desirable to be able to conduct evaluations naturally in everyday life and learn the evaluation result from the outside. Thus, according to the present invention, the walking function of the monitoring subject is monitored in everyday life.

First Embodiment

<Configuration of Monitoring System>

Figure 1:
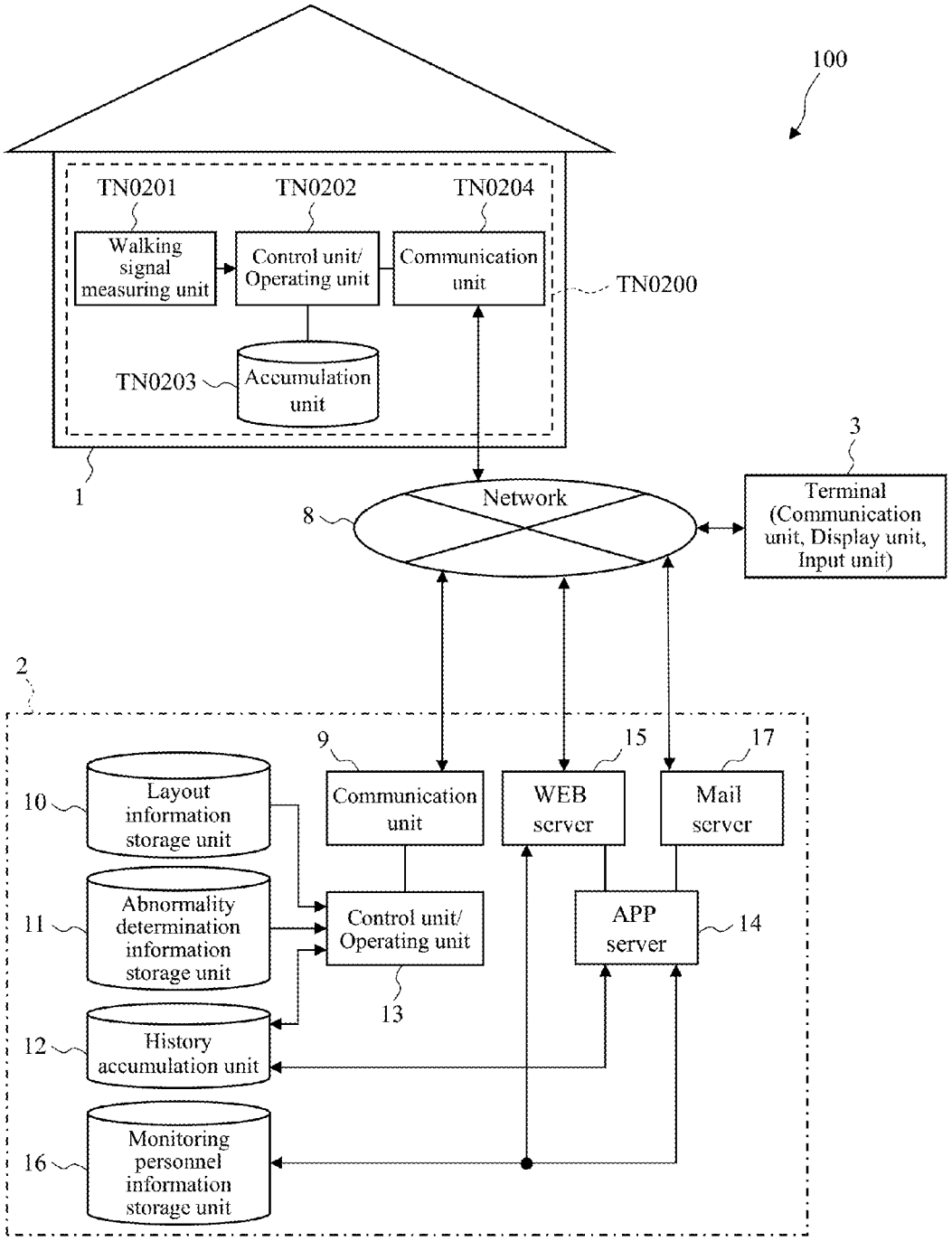
FIG. 1 is an overall configuration diagram of a monitoring system according to a first embodiment of the present invention.

FIG. 1 shows an overall configuration diagram of a monitoring system according to a first embodiment of the present invention. The monitoring system 100 is provided with three major constituent elements. These are a facility 1 in which a monitoring subject (subject) resides or stays; an information processing system 2 that provides a monitoring service; and a terminal 3 utilized by monitoring personnel.

The facility 1 is provided with a measuring system TN0200 for chronologically measuring the position of the subject in the facility 1. The measuring system TN0200 includes a walking signal measuring unit TN0201 that measures a walking signal using a sensor; a control unit/operating unit TN0202 that controls the walking signal measuring unit TN0201 and executes an arithmetic operating process with respect to the measured signal; an accumulation unit TN0203 that accumulates results of operation by the control unit/operating unit TN0202; and a communication unit TN0204 with the function of communicating an operation result to the outside.

The information processing system 2 determines the health state of the monitoring subject by determining whether a chronological change in the position of the monitoring subject satisfies a condition in an abnormality determination table (FIG. 17), which will be described later. The information processing system 2 includes a communication unit 9 that receives information transmitted from the communication unit TN0204 of the measuring system TN0200 installed in the facility 1 via the network 8; a layout information storage unit 10; an abnormality determination information storage unit 11; a history accumulation unit 12; a control unit/operating unit 13 that performs behavior analysis, walking function evaluation, and abnormality determination for the monitoring subject; and a monitoring person information storage unit 16. In the information processing system 2, results of operation by the control unit/operating unit 13 and the information from the measuring system TN0200 are accumulated in the history accumulation unit 12.

The information processing system 2 is further provided with an application server (APP server) 14, a WEB server 15, and a mail server 17. The application server 14, by referring to the information accumulated in the history accumulation unit 12, provides an application function of displaying the state or history of the monitoring subject on the terminal 3. The WEB server 15 provides a screen for displaying the state or history of the monitoring subject in response to a request from the terminal 3 via the network 8, such as the Internet. The mail server 17 transmits mail notifying normal-time monitoring personnel or emergency personnel about the state of the monitoring subject, using the information in the monitoring person information storage unit 16.

The application server 14 and the WEB server 15, using management information registered in the monitoring person information storage unit 16, select display content in accordance with the ID of the monitoring personnel accessing the WEB server. The terminal 3 includes a communication unit that receives, via the network 8, the results of evaluation of the walking function of the monitoring subject, behavior analysis, and abnormality determination from the information processing system 2 providing the monitoring service. The terminal 3 further includes a display unit that displays the received information, and an input unit that makes an input as needed. The terminal 3 may include a PC, a smartphone, a tablet terminal, or a portable telephone, for example.

The configuration of each of the bases may not be independent in terms of hardware; instead, a plurality of functions may be realized in integrated hardware. The information processing system 2 that provides the monitoring service and the terminal 3 that receives information from the information processing system 2 and that inputs information to the information processing system 2 may be present at the same base. Further, a plurality of terminals 3 may be used. By monitoring at a plurality of locations, more reliable monitoring can be expected. As will be described later, the monitoring service may be provided by combining the normal-time monitoring personnel and the emergency response personnel. By allowing the terminal 3 for the monitoring service to be possessed by a family member and the like living in a remote location, the state of the monitoring subject can be confirmed remotely.

The constituent elements of the measuring system TN0200 and the information processing system 2 are provided by an information processing device, such as a computer or a workstation. The information processing device is provided with a central processing device, a storage unit such as a memory, and a storage medium. The central processing device includes a processor such as a central processing unit (CPU). The storage medium is a non-volatile storage medium, for example. The non-volatile storage medium may include a magnetic disk or a non-volatile memory and the like. The storage unit and the accumulation unit are realized by a storage unit, such as a storage medium or a memory. The storage medium stores a program and the like for realizing the functions of the monitoring system. In the memory, the program stored in the storage medium is loaded. The CPU executes the program loaded in the memory. Thus, the processes of the monitoring system hereinafter described may be realized in the form of a program executed on the computer. The configuration of the embodiment may be partly or entirely designed in an integrated circuit for hardware implementation.

<Configuration of Facility>

Figure 2:
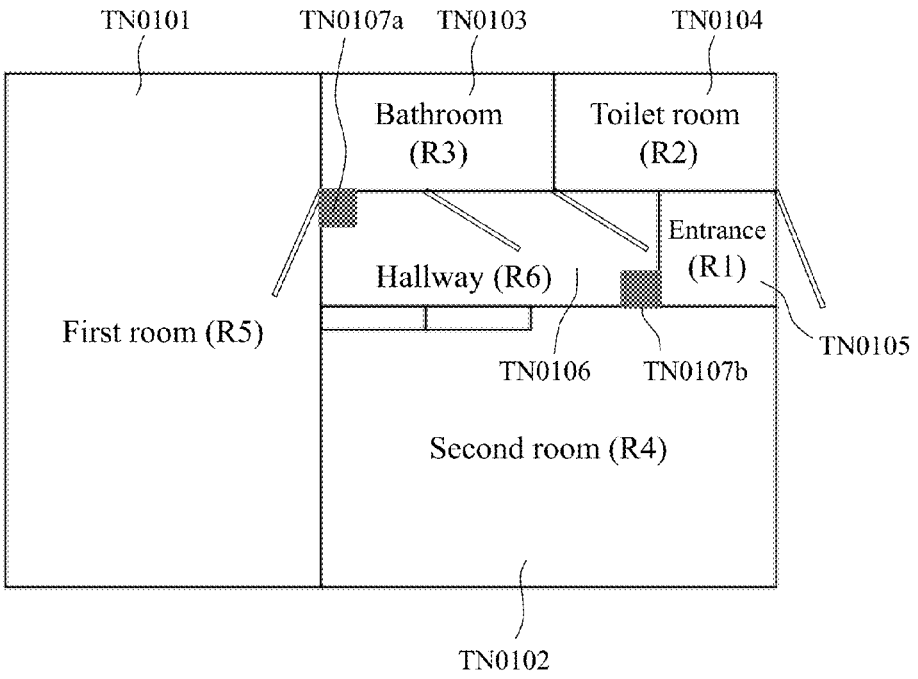
FIG. 2 illustrates the layout of a facility in which a monitoring subject lives, and sensor installed positions.

The system in the facility 1 will be described. FIG. 2 illustrates an example layout of the building of the facility 1. The facility 1 includes a first room TN0101, a second room TN0102, a bathroom TN0103, a toilet room TN0104, and an entrance TN0105. The rooms are connected by a hallway TN0106. Sensors TN0107*a* and TN0107*b* are installed at two locations at the ends of the hallway TN0106, for example, to perform sensing in the facility 1. In FIG. 2, the subscripts a, b, . . . and so on indicate similar constituent elements, and may be omitted unless particularly required.

Figure 3:
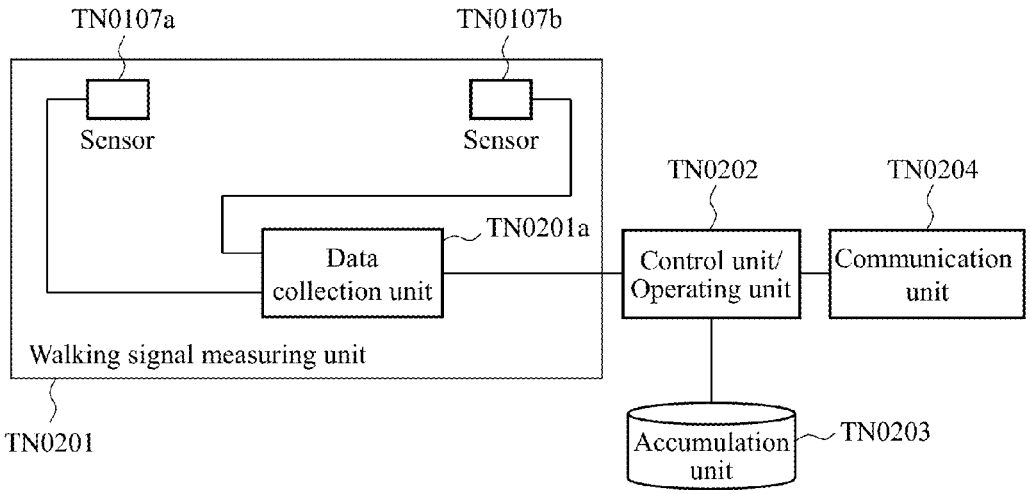
FIG. 3 is a configuration diagram of a facility measuring system.

FIG. 3 shows a configuration diagram of the measuring system TN0200 in the facility 1, illustrating the system in the facility 1 of FIG. 1 in greater detail. The measuring system TN0200 is a system that senses sound or vibration using the sensors and that acquires information about the position of the monitoring subject and his or her walking. The measuring system TN0200 is provided with the sensors TN0107*a* and TN0107*b*, a data collection unit TN0201*a*, the control unit/operating unit TN0202, the accumulation unit TN0203, and the communication unit TN0204.

The sensors TN0107 are installed in the facility 1 to sense the sound or vibration of someone moving. The data acquired by the sensors TN0107 are collected by the data collection unit TN0201*a*. The data collected by the data collection unit TN0201*a* are accumulated in the accumulation unit TN0203 via the control unit/operating unit TN0202. The control unit/operating unit TN0202 performs a data analyzing process with regard to the data collected by the data collection unit TN0201*a*. The control unit/operating unit TN0202 also controls the walking signal measuring unit TN0201 and the accumulation unit TN0203. A result of data analysis by the control unit/operating unit TN0202 is transmitted via the communication unit TN0204 onto the network 8. The control unit/operating unit TN0202 may also implement control or perform computations on the basis of the data from the communication unit TN0204.

<Measurement of Sound Source Position>

The details of sound source position measurement in the present embodiment will be described. In the monitoring system, the sensors TN0107 are used to identify the position at which footstep sound was produced as the monitoring subject walks, a route of movement or location in the facility 1 is identified, and the speed of movement is measured, for example.

Figure 4:
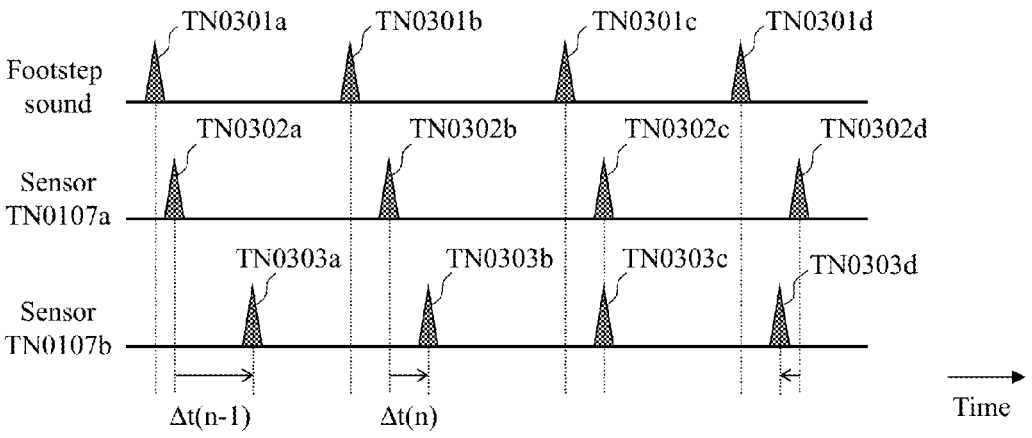
FIG. 4 illustrates the principle of identification of the position at which footstep sound is produced.

FIG. 4 is a figure for describing the principle of identification of the footstep sound produced position. Between the timing when footstep sound was produced (TN0301*a*, TN0301*b*, . . . ) and the timing when a footstep sound signal is received by the sensors TN0107 (sensor TN0107*a*: TN0302*a*, TN0302*b*, . . . ; sensor TN0107*b*: TN0303*a*, TN0303*b*, . . . ), a propagation delay time is caused in accordance with the distance from the location at which the footstep sound was produced to the sensors TN0107*a* and TN0107*b*. For example, the speed at which sound propagates in air is approximately 340 m/s when the atmospheric temperature is 15° C. Thus, if there is a distance of 1 m between the sensors TN0107*a* and TN0107*b*, a delay time of approximately 3 milliseconds will be caused. A propagation delay time is also caused when a vibration caused by walking on a rigid body, such as the hallway, propagates.

As the location at which the footstep sound is produced moves, the arrival time of reception of sound by the sensors TN0107*a* and TN0107*b* varies. When the speed of propagation of sound is $v_s$, the arrival time is delayed by time determined by dividing the distance from the sound source to the sensor by $v_s$. Thus, when sound from one sound source is received by the two sensors TN0107*a* and TN0107*b*, the following relational expression holds.

$$\{x_f(n)-x_1\}-\{x_2-x_f(n)\}=\Delta t(n)\cdot v_s$$

where $x_f(n)$ is the position of the sound source that produced sound, $x_1$ is the coordinates of the sensor TN0107*a*, $x_2$ is the coordinates of the sensor TN0107*b*, and $\Delta t(n)$ is the time difference in reception of the sound between the sensors TN0107*a* and TN0107*b*. The subscript n indicates the sound source position or measured time difference data of the n-th sound. The expression can be modified as follows.

$$x_f(n)=\{\Delta t(n)\cdot v_s+(x_2-x_1)\}/2$$

Thus, if the coordinates of the sensors TN0107*a* and TN0107*b*, the propagation speed of the sound, and the reception time difference between the sensors TN0107*a* and TN0107*b* are known, the sound source position can be calculated. The coordinates of the sensors TN0107*a* and TN0107*b* are known at the time of installation. The propagation speed of sound can be handled as a known value although it may depend on the atmospheric temperature or the medium and the like. Thus, by measuring $\Delta t(n)$, the sound source position can be calculated.

<Footstep Sound Position Calculation Flow>

Figure 5:
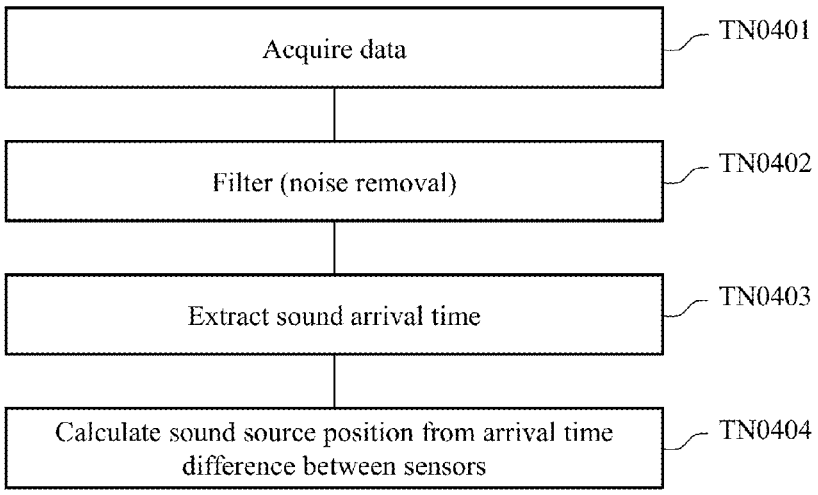
FIG. 5 shows an example of the flow of signal processing for calculating the position of footstep sound.

FIG. 5 shows an example of the flow of signal processing for calculating the position of footstep sound. The following process is performed mainly by the control unit/operating unit TN0202 of the measuring system TN0200.

First, the data of the footstep sound from the sensors TN0107 installed in the facility 1 are acquired (TN0401). In order to modify the acquired data into data suitable for time difference extraction, a filtering process is performed on the acquired data (TN0402). Specifically, for example, a frequency filter is used to extract signals in a certain predetermined frequency range, or a noise removal process is performed. Also, in order to increase the signal-to-noise ratio, a process of integrating in frequency direction and the like may be performed.

After the processes are performed on the data from each of the sensors TN0107, the arrival time difference of received signals is calculated (TN0403). Specifically, for example, in order to extract the arrival time of each signal, time differentiation is performed. Then, by extracting the time at which the differentiation value peaks, the time at which the sound change is large, namely, the sound arrival time is determined. The sound arrival time is determined for the data from each of the sensors TN0107, and the difference in their arrival times is computed to calculate the sound arrival time difference and to compute the sound source position (TN0404). In another method, a mutual correlation function of the data from the sensors TN0107 may be computed, and the time difference with the highest correlation may be considered the arrival time difference. The arrival time difference calculated as described above is used to identify the sound source position.

The sound source position may be identified without using the propagation time. For example, a method uses sound intensity. Based on the intensity ratio of sounds received by the sensors TN0107*a* and TN0107*b*, the sound source position may be calculated. However, this method may be readily affected by the influence of sound directionality, whereby an error may be caused in the calculation result. An error may also be caused by the non-linear attenuation of sound with respect to distance. In such cases, a propagation delay time difference may be used to calculate the sound source position, whereby the sound source position can be accurately calculated.

According to the present embodiment, the sound source position is calculated using the arrival time difference. Thus, the data from the sensors TN0107 are synchronized by the data collection unit TN0201*a* and then acquired. For example, in air, sound takes approximately 0.3 milliseconds to travel a distance of approximately 10 cm. Thus, with regard to synchronization accuracy, in order to obtain a positional accuracy on the order of 10 cm, synchronization is performed with higher accuracy than the time of approximately 0.3 milliseconds in the case of air. In order to accurately calculate the arrival time difference, it is preferable to acquire the data from the sensors TN0107 that are synchronized with an error of 0.1 millisecond or less.

Further, in order to calculate the arrival time difference accurately, it is necessary to acquire the data at a certain frequency or above. In order to perform position measurement with an error on the order of 10 cm or less, it is preferable to perform sampling at a sampling frequency of 10 kHz or above.

Figure 6:
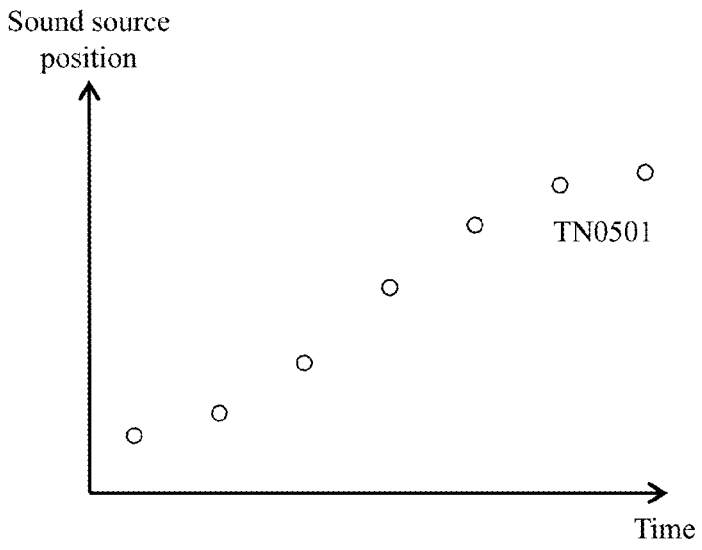
FIG. 6 shows a plot of changes in the sound source position over time based on sensor data.

FIG. 6 shows a plot of changes over time (TN0501) in the sound source position as calculated on the basis of the data from the sensors TN0107. When a person is walking and moving, the sound source position changes over time. From such chronological data, the motion or location of the person, and the walking speed can be learned.

<Walking Speed Calculation Flow>

Figure 7:
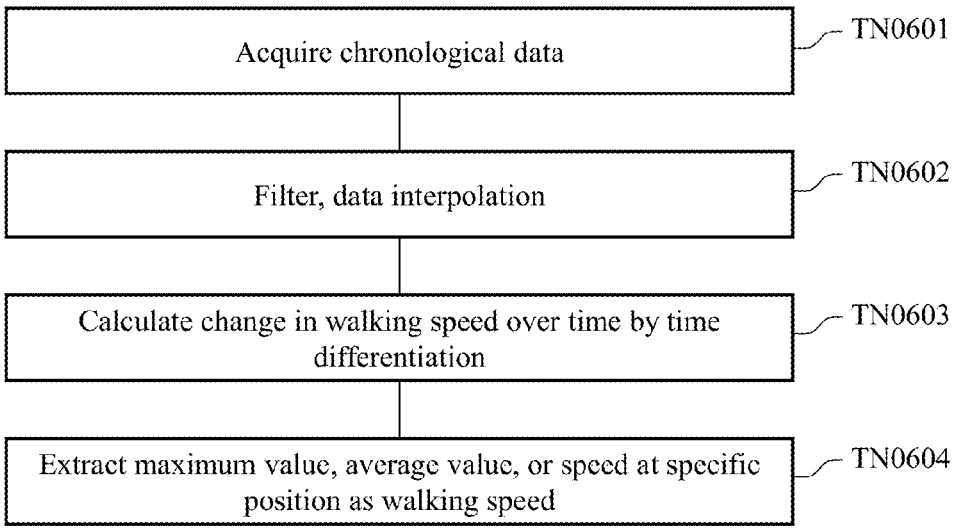
FIG. 7 shows the flow of calculating walking speed from chronological data of the sound source position of footstep sound.

FIG. 7 shows the flow of calculation of walking speed from the chronological data of the sound source position of footstep sound. The following process is performed mainly by the control unit/operating unit 13 of the information processing system 2.

First, the chronological data TN0501 (see FIG. 6) of the time at which the footstep sound was produced and the sound source position are acquired (TN0601). Then, the chronological data TN0501 is subjected to filtering or interpolation as needed for conversion into data suitable for calculation of walking speed (TN0602). The interpolation may include spline interpolation, linear interpolation and the like.

Then, the converted data is subjected to time differentiation so as to calculate the change in walking speed over time (TN0603). From the data of change in walking speed over time, a maximum value, an average value and the like are extracted, and a walking speed is calculated (TN0604).

When the walking speed is calculated, the walking speed may differ when the walking distance is short and when long. Thus, when the walking speed is compared with a past walking speed, for example, it is preferable to make the comparison in the same condition. For example, in one method, the comparison is based on the maximum walking speed observed when the person walked over a certain distance or greater. In another method, the walking speed observed at a specific position, such as at around the center of the hallway, may be extracted for comparison.

In another example, sensors may be installed at the doors or entrance/exits of the rooms, and the time difference in movement from one room to another may be measured so as to determine the walking speed from the moving distance. However, it is difficult to calculate the walking speed accurately by such method because the time difference includes the time for which the person may stop at around the entrance/exits of the rooms or open or close the doors, and also because the walking speed may vary when going in or out of the rooms. In contrast, according to the present embodiment, by calculating the walking speed from the chronological data of the sound source position, the change over time in walking speed, its maximum value and average value, and the time for which the person is standing still can also be recognized. In addition to the walking speed, a walking period may be calculated from the chronological data of the sound source position of the footstep sound.

<Example of the Chronological Data of the Sound Source Position of Footstep Sound>

FIG. 8 shows an example of the data set transmitted from the measuring system TN0200 to the information processing system 2 on a network and accumulated in the information processing system 2.

As shown in FIG. 8, with regard to data of each step, the time at which sound was generated and the sound source position are accumulated in the history accumulation unit 12 of the information processing system 2. From the sound data, not only the sound source position data but also a sound intensity or a feature quantity in a frequency region may be extracted. The data are used for calculation of walking parameters (such as walking sound intensity, walking period, walking position, and walking speed). In the history accumulation unit 12 of the information processing system 2, there may also be accumulated a sound intensity, a sound frequency feature quantity and the like as needed. The information processing system 2, on the basis of the accumulated data, performs a process of estimating the room in which the monitoring subject is staying, and a process of determining the walking function of the monitoring subject. Upon sensing abnormality in the monitoring subject, the information processing system 2 performs a process of notifying the terminal 3, for example.

In the above configuration, it has been described that after data are analyzed by a device installed in the facility 1, the data is accumulated in the history accumulation unit 12 in the information processing system 2 via the network 8. However, this is not a limitation. The data from the sensors TN0107 may be directly transmitted to the history accumulation unit 12 of the information processing system 2, and all of the computations may be performed within the information processing system 2 rather than by the device installed in the facility 1. When a certain amount of processing is performed by the local system in the facility 1 (the measuring system TN0200), only data with high level of abstraction can be sent via the network 8, whereby increased security can be achieved. Further, the amount of data transmitted to the information processing system 2 can be decreased, whereby the amount of communication can be reduced.

Meanwhile, the information processing system 2 may be configured for cloud computing implementation. In this case, all data may be accumulated in the information processing system 2 being present on a cloud, and data processing may be performed therein, whereby abundant computing resources may be utilized. By accumulating all of raw signal data prior to processing in the information processing system 2, it becomes possible to perform an analysis by tracing back in time when a new application is developed, or an application is updated or added.

In another configuration, data with high level of abstraction may be normally transmitted from the measuring system TN0200 in the facility 1 to the information processing system 2 via the network 8, and the raw data may be transmitted only upon request from the information processing system 2. Specifically, for example, the raw data for one day are accumulated in the accumulation unit TN0203 of the measuring system TN0200, and the raw data for a time band concerning the request from the information processing system 2 may be transmitted to the information processing system 2.

In the present embodiment, the two sensors TN0107*a* and TN0107*b* are located in the facility 1, and the linear position of the monitoring subject is calculated. However, the configuration is not a limitation. In principle, a position on a two-dimensional plane can be calculated when at least three sensors are disposed. For example, a total of four sensors are installed at the four corners of the hallway or a room, and the walking sound in that space may be acquired to identify the position of the monitoring subject. By performing two-dimensional position identification, the movement route in the space can be calculated.

A one-dimensional position may be computed using two or more sensors. For example, four sensors may be used to identify a one-dimensional position. In this case, the amount of information that can be used for computation is increased, whereby the position identification accuracy can be increased. Further, even if data could not be acquired by some of the sensors, the position can still be calculated using data from the other sensors.

<Walking Sound Discrimination Flow>

When the walking state is determined using a signal due to vibration of the floor or air, such as the footstep sound, it is necessary to distinguish whether the detected vibration is footstep sound caused by walking (walking sound). Herein, a walking sound discrimination method will be described.

Figure 9:
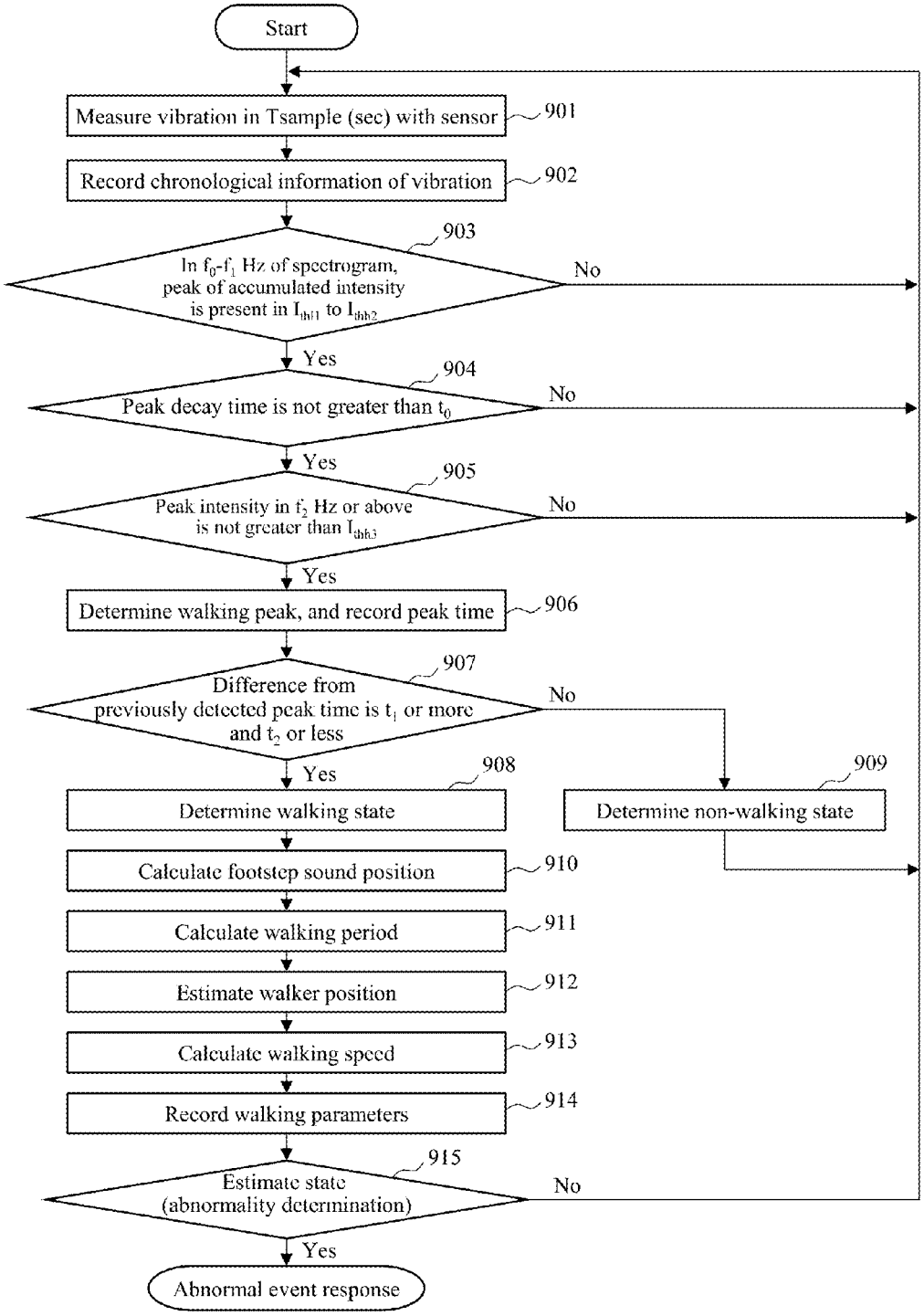
FIG. 9 shows the flow of a walking sound discriminating algorithm.

FIG. 9 shows the flow of a walking sound discriminating algorithm. As an example, a case will be described in which vibration detection sensors, such as microphones, are used as the sensors TN0107*a* and TN0107*b*. In FIG. 9, the process of steps 901 to 910 is performed mainly by the control unit/operating unit TN0202 of the measuring system TN0200. The process of step 911 to 915 is mainly performed by the control unit/operating unit 13 of the information processing system 2.

First, at time intervals ($T_{sample}$) that are previously set, vibrations such as the environmental sound are measured continuously (chronologically) by the vibration detection sensor system, such as the microphones (901). The chronological data of the environmental sound and the like are recorded (902).

Then, the chronological data of vibration in a time $T_{sample}$ are analyzed. Specifically, a spectrogram of the acquired chronological data of vibration in the $T_{sample}$ is determined, and it is determined whether there is a peak signal in a certain intensity range ($I_{thl1}$ to $I_{thh2}$) in a certain low frequency region ($f_0$ to $f_1$) (903). This will be referred to as "first walking peak discrimination".

Different countries have different modes of living. For example, in one mode, people take off their shoes in the facility 1. In another mode, people have their shoes on in the facility 1. In the former mode, people often walk in the facility 1 in a soft-sole state, such as being barefoot or wearing socks or slippers. Thus, the vibrations due to walking sound in the residence or building have strong low frequency component, the signal intensity of which staying within a limited fluctuation range. This property may be utilized to determine the walking peak. In the latter mode, the first walking peak discrimination can also be performed. The frequency region ($f_0$ to $f_1$) and the intensity range ($I_{thl1}$ to $I_{thh2}$) for discrimination may be determined in advance by measuring vibration information of the observed subject in the building as the object of observation when walking.

If there is no peak signal satisfying the first walking peak discrimination, it is determined that there is no peak signal due to walking, and the process returns to step 901. If there is a peak signal, the process proceeds to step 904 for second walking peak discrimination.

In the second walking peak discrimination, it is determined whether the decay time of the peak signal that met the first walking peak discrimination is not greater than $t_0$ (904). This discriminating condition is provided to distinguish low frequency noise other than walking and walking sound by utilizing the feature that, because the walking sound is a collision sound of a foot landing on the floor, the walking sound has high rate of decay in signal intensity. If there is no peak signal satisfying the condition, the process returns to step 901, determining that there is no peak signal due to walking. If the peak signal is present, the process proceeds to step 905 for third walking peak discrimination.

In the third walking peak discrimination, it is determined whether the peak signal satisfying the second walking peak discrimination is not lower than a certain frequency ($f_2$) and the intensity thereof is not greater than a certain signal intensity ($I_{thh3}$) (905). This discriminating condition is provided so as to distinguish a large sound other than walking and walking sound by utilizing the property that the vibration caused during walking in the building does not have much high frequency component. The frequency ($f_2$) and signal intensity ($I_{thh3}$) used for the discrimination are determined in advance by measuring the vibration information as the observed subject walks in the building as the object of observation. If there is no peak signal satisfying the condition, it is determined that there is no peak signal due to walking, and the process returns to step 901. If there was the peak signal, the process proceeds to step 906.

The peak signal satisfying the third walking peak determination is determined to be due to walking (906). The peak time of the signal determined to be the walking peak signal is recorded (906).

It is then determined whether the time difference between the time at which the peak signal of the previously detected walking sound was generated and the time at which the peak signal of the currently detected walking sound was generated is within a certain time ($t_1$ to $t_2$) (907). By this determination, it is determined whether the monitoring subject is in walking state. The determination is based on the feature that, although a person's walking period may vary slightly depending on his or her health state such as physical condition, the walking period stays within a certain shift range. If the condition is not met, it is determined that the subject is not in walking state (908), and the process returns to step 901. If the condition is satisfied, it is determined that the monitoring subject is in walking state (908).

If it is determined that the monitoring subject is in walking state, the sound source position of the footstep sound is calculated (910). For example, the flow described with reference to FIG. 5 is executed. Thereafter, information about the times, the position of the monitoring subject, the footstep sound signal intensity, the footstep sound signal frequency and the like are transmitted to the information processing system 2.

Then, the walking period is calculated from the time intervals at which the signal peaks due to walking are generated (911). Thereafter, the position of the monitoring subject is estimated (912). The method of position estimation will be described in detail later. On the basis of the chronological change in the estimated walking position, the walking speed is calculated (913). The walking period, walking speed, walking sound intensity, walking position and the like are recorded in the history accumulation unit 12 of the information processing system 2 as walking parameters (914).

Then, the walking parameter information, the position of the monitoring subject, and an abnormality determination table (see FIG. 17) in the abnormality determination information storage unit 11 are used to estimate the state of the monitoring subject (915). If it is determined that the state of the monitoring subject is not abnormal, the process returns to step 901. If it is determined that the condition is abnormal, the process is handed over to an abnormal event response as will be described later (see FIG. 18). By the above-described method, the walking sound is distinguished and the health state of the monitoring subject is determined.

The first walking peak discrimination to the third walking peak discrimination of FIG. 9 (steps 903 to 905) will be described with reference to FIG. 10 to FIG. 13. Herein, an example in which the subject walks in the hallway in the facility 1 wearing socks will be described.

Figure 10:
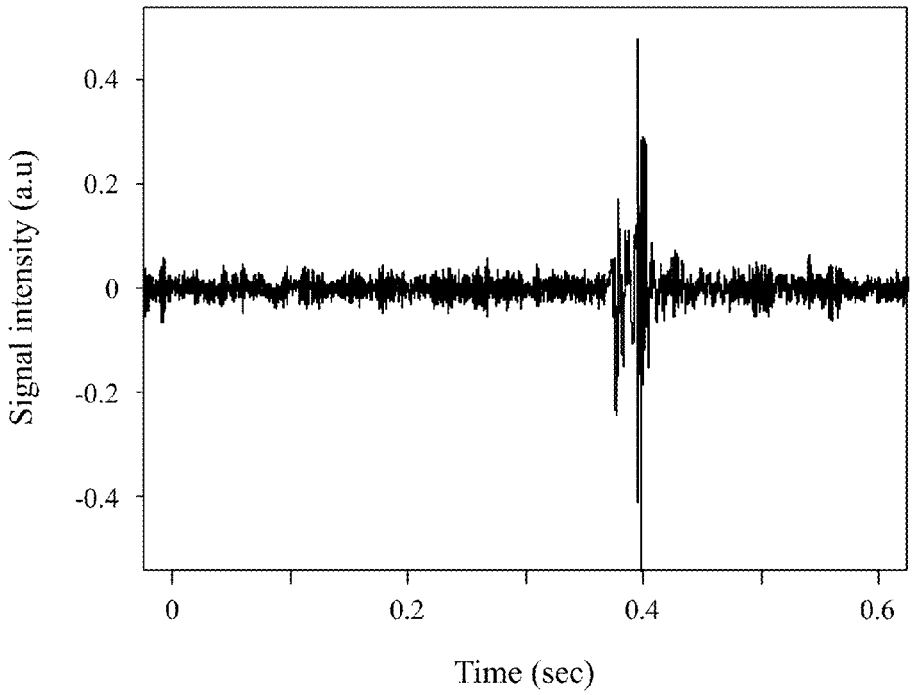
FIG. 10 shows a sound pressure measurement example obtained when environmental sound was measured with a microphone.

FIG. 10 shows chronological data of sound pressure observed when the environmental sound was measured with the microphones at time intervals ($T_{sample}$) of 0.6 second. A large peak is observed at around 0.4 second, and it is determined whether the peak is due to walking.

First, a spectrogram of the chronological data of the measured sound pressure is determined, and it is examined if there is a peak of $I_{thl1}$=35 dB or greater and $I_{thh2}$=55 dB or less in the chronological data of integrated intensity in a frequency region of $f_0$=100 Hz to $f_1$=400 Hz.

Figure 11A:
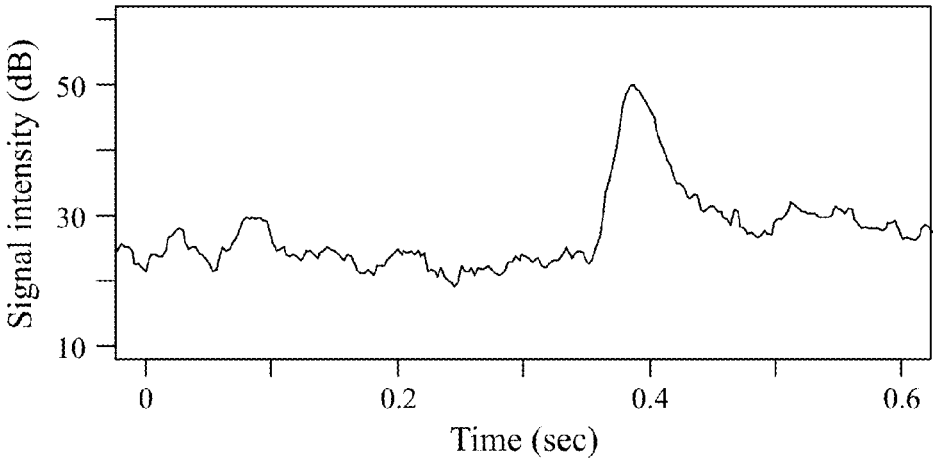
FIG. 11A shows integrated-intensity chronological data in a specific frequency region in the measurement example of FIG. 10, specifically in the frequency region of 100 Hz to 400 Hz.

FIG. 11A shows the chronological data of integrated intensity in the frequency region of 100 Hz to 400 Hz. It will be seen that there is a peak of 35 dB or more and 55 dB or less at around 0.4 second. Thus, it is seen that the example of FIG. 11A satisfies the first walking peak discrimination.

Then, the detected peak decay time is examined, herein by determining whether $t_0$ is 0.1 second or less, where $t_0$ is the decay time required for a decrease of 10 dB from the detected peak intensity. In FIG. 11A, the time required for a decrease in peak intensity from 50 dB to 40 dB was 0.03 second, showing that the second walking peak discrimination is satisfied.

Figure 11B:
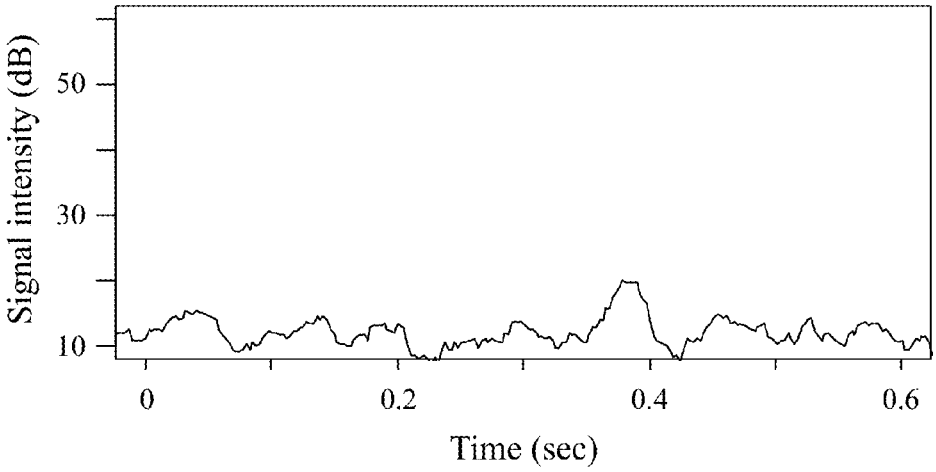
FIG. 11B shows integrated-intensity chronological data in a specific frequency region in the measurement example of FIG. 10, specifically in the frequency region of 1 kHz or above.

Then, it is examined whether the intensity around 0.4 second of the integrated-intensity chronological data in the frequency region of 1 kHz or above is 40 dB or less. FIG. 11B shows the integrated-intensity chronological data in the frequency region of 1 kHz or above. Because the intensity at around 0.4 second is not more than 40 dB, it is seen that the third walking peak discrimination is satisfied. From the above, it is determined that the peak signal around 0.4 second in FIG. 10 is due to walking, and the time 0.38 second of peak generation is recorded.

Figure 12:
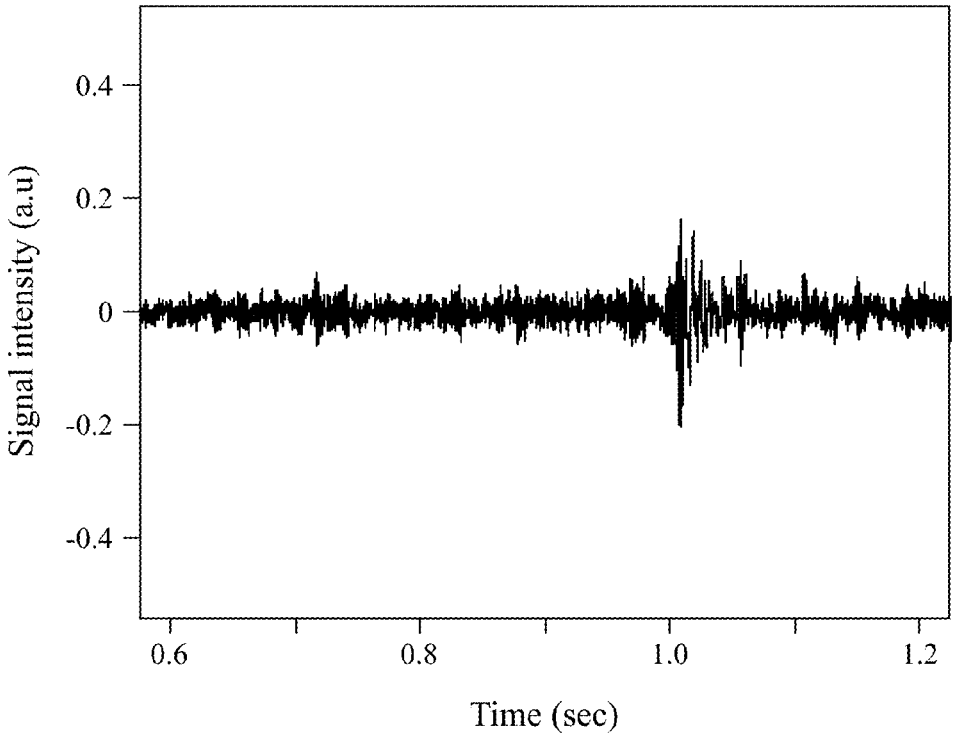
FIG. 12 shows a sound pressure measurement example obtained when environmental sound was measured with a microphone.

The calculation (step 907 of FIG. 9) of the difference from the previously detected time of walking peak generation will be described. It is herein presumed that the peak at around 0.4 second in FIG. 10 is the first walking peak, and the sound measurement of the time $T_{sample}$ is performed again. FIG. 12 shows chronological data observed when sound pressure of the time $T_{sample}$ was measured again. In FIG. 12, a large peak is observed at around 1.0 second, and it is determined, as in the above-described case, whether the peak is due to walking.

Figure 13A:
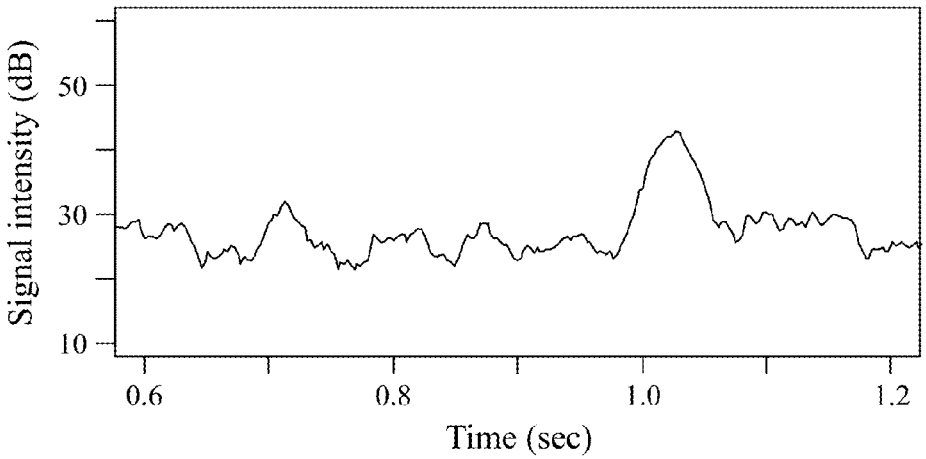
FIG. 13A shows integrated-intensity chronological data in a specific frequency region in the measurement example of FIG. 12, specifically in the frequency region of 100 Hz to 400 Hz.
Figure 13B:
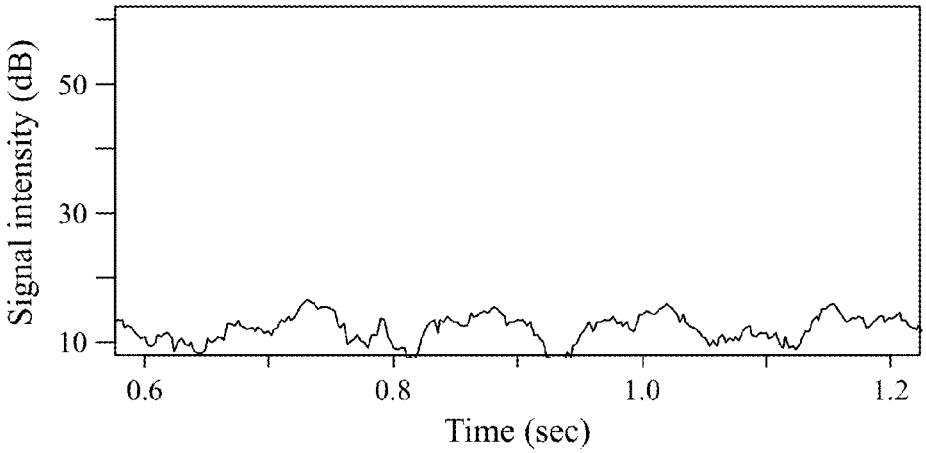
FIG. 13B shows integrated-intensity chronological data in a specific frequency region in the measurement example of FIG. 12, specifically in the frequency region of 1 kHz or above.

FIG. 13A shows the chronological data of integrated intensity in a frequency region of 100 Hz to 400 Hz. It is seen that there is a peak of 35 dB or more and 55 dB or less at around 1.0 second. Thus, it is seen that the example of FIG. 13A satisfies the first walking peak discrimination.

The peak has a decay time of 0.05 second, and from the integrated-intensity chronological data of a frequency region of 1 kHz or above (FIG. 13B), the intensity at around 1.0 second is not more than 40 dB. Thus, it is determined that the peak signal is due to walking, and the time 1.03 seconds of peak generation is recorded.

If the difference between the time of peak generation (1.03) and the previous time of peak generation (0.38) is $t_1$=0.25 second or more and $t_2$=1 second or less, it is determined that there is walking state. Because 1.03-

0.38=0.65 second and the condition is satisfied, it can be determined that the monitoring subject is in walking state.

While the first walking peak discrimination to the third walking peak discrimination (step 903 to 905) have been described, the walking sound discriminating algorithm is not limited to the above combination. For example, the discriminating condition may be defined by a condition concerning at least one of an intensity range in a predetermined frequency region with respect to the peak signal, and the peak signal decay time. Other conditions may also be set. Further, while the values of low frequency component intensity, high frequency component intensity, decay time and the like have been determined using previously set simple threshold values, the values may be determined by a data mining or machine learning technique using a neural network or a support vector machine and the like.

While microphones were used as the sensors TN0107 and vibrations due to walking were observed as sound, other configurations may be used. For example, vibration transmitted from the floor or a wall may be detected using a microphone, a piezo vibration sensor, an acceleration sensor, or a distortion sensor. In this case, fine vibrations can be detected by the piezo vibration sensor or the acceleration sensor. The distortion sensor can detect vibrations with low vibration frequencies.

<Example of Chronological Change in Walking Sound>

A typical example of the chronological change in signal intensity that is observed when a foot lands on ground during walking will be described. The signal intensity herein may include the absolute value of the amplitude of the walking sound detected with a vibration sensor such as a microphone, or the intensity of only the low frequency component of walking sound. It is considered that the walking sound will be detected from the left and right legs alternately. Herein, it is considered for convenience's sake that the initially detected walking sound corresponds to the right leg and the next detected walking sound corresponds to the left leg, which will be respectively indicated by a solid line and a broken line.

Figure 14A:
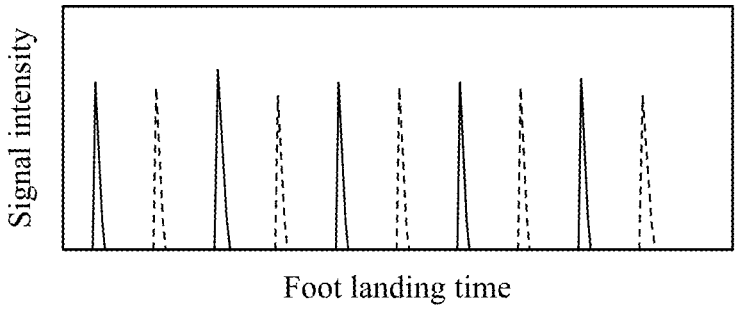
FIG. 14A shows an example of chronological change in signal intensity observed when a foot lands on ground.
Figure 14B:
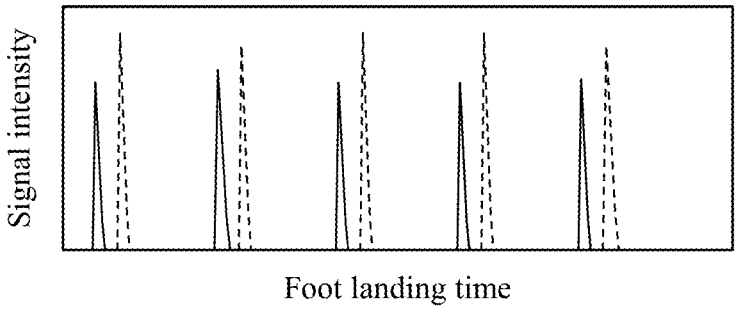
FIG. 14B shows an example of chronological change in signal intensity observed when a foot lands on ground.
Figure 14C:
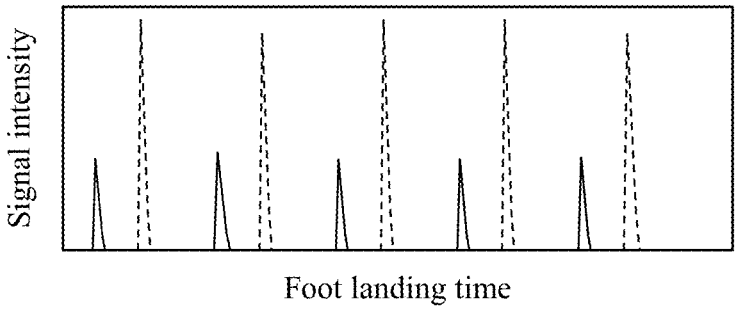
FIG. 14C shows an example of chronological change in signal intensity observed when a foot lands on ground.

FIG. 14A shows a typical example of an able-bodied person. The left and right leg landing periods and the fluctuation ranges of left and right leg landing intervals are small, so that the left and right signal intensity difference is small. On the other hand, when the person has a defect, such as a pain in the joint and the like of one leg due to osteoarthritis, for example, the left and right leg landing intervals become non-uniform (FIG. 14B). In another example, the signal intensity may be greatly varied (FIG. 14C).

Even when the non-uniformity in walking period or signal intensity is small, the period may become longer than a fluctuation range (FIG. 14D). In yet another example, the signal intensity may become weaker than a fluctuation range for normal time (FIG. 14E). In this case, a decrease in walking capability due to debilitation is suspected. In the present embodiment, such walking modes are analyzed by the control unit/operating unit 13 of the information processing system 2, and if a previously set variation range of the walking sound interval (walking period) or the signal intensity is exceeded, abnormality is determined. If abnormality is determined, an abnormal event response is taken. The variation range for abnormality recognition may be determined by comparing the walking sound width interval or the signal intensity with the walking sound width interval or the signal intensity at a timing traced back in time by a previously set period, such as one month or one year. While the patterns of the combination of the walking sound interval and the signal intensity have been described with reference to FIG. 14B to FIG. 14E, abnormality determination may be based on at least one of walking sound interval and signal intensity.

<Table Configuration>

The data stored in the layout information storage unit 10, the abnormality determination information storage unit 11, the history accumulation unit 12, and the monitoring person information storage unit 16 of the information processing system 2 will be described. In the following, the information in the storage units 10, 11, and 16 and the accumulation unit 12 will be described with reference to "table" structure. However, the information may not necessarily be represented in table data structure, and may be represented in list or cue data structure or other structures. Thus, in order to indicate that the information does not depend on data structure, "table", "list", "cue" and the like may be simply referred to as "information".

FIG. 15 shows an example of a layout table stored in the layout information storage unit 10. The layout table 1500 corresponds to the layout of the facility 1 illustrated in FIG. 2. The layout table 1500 includes the constituent items of layout ID 1501, category 1502, entrance/exit center position 1503, position determination minimum value 1504, and position determination maximum value 1505.

The table is created as follows. When the two sensors, namely the sensors TN0107*a* and sensor TN0107*b*, are installed in the facility 1, the distance between the sensors is measured. Meanwhile, a signal is generated by hitting the floor at a point at a certain distance from the sensor TN0107*b*, and the above-described sound source position calculation process is performed by the system. Data are acquired at several locations, and if an error is caused between the calculated position and an actual measurement value, the computation expression is corrected.

Further, the distance from one of the sensor TN0107*b* to the center of the entrance of each room is measured and recorded. The distances are arranged in increasing order, and layout IDs are allocated. Herein, for the sake of description, what are usually not called "rooms" may be referred to as "rooms", such as the bathroom and the entrance. The entrance, the toilet room, the bathroom, the living room which may be used as a bed room, the living room which is not used as a bed room, and the hallway are distinguished, and a room category is allocated to each layout ID.

The distance between the sensor TN0107*b* and the center of the entrance to the room with the layout ID(R1) is DR1; the distance between the sensor TN0107*b* and the center of the entrance to the room with the layout ID(R2) is DR2; and the distance between the sensor TN0107*b* and the center of the entrance to the room with the layout ID(R3) is DR3. In this case, for the room R2, a position determination minimum value 1504 is set as (DR2+DR1)/2, and a position determination maximum value 1505 is set as (DR3+DR2)/2. Specifically, the position determination minimum value 1504 for the room R2 is (0.9+0)/2=0.45. The position determination maximum value 1505 for the room R2 is (1.5+0.9)/2=1.2.

In FIG. 15, for the sake of description, an example of the values of DR1 to DR5 (center position 1503 values), and the position determination minimum value 1504 and the position determination maximum value 1505 in the case of the example are shown. Because what are actually used are the position determination minimum value 1504 and the position determination maximum value 1505, the values of DR1 to DR5 may not necessarily be retained after the minimum and maximum values are computed. With regard to the layout IDs at the ends, namely R1 and R6, the position determination minimum value 1504 or the position determination maximum value 1505 does not exist. The layout table 1500 storing such data is stored in the layout information storage unit 10 of the information processing system 2.

FIG. 16A shows an example of a state information table 1600 stored in the history accumulation unit 12. The state information table 1600 stores the information about the state of the monitoring subject in the information processing system 2. The state information table 1600 includes the constituent items of state ID 1601, location 1602, state start date/time 1603, continuation time 1604, abnormality determination 1605, contact ID 1606, and contact date/time 1607.

In the location 1602, a value corresponding to the layout ID 1501 in the layout table 1500 is stored. The state start date/time 1603 indicates the date/time of start of a stay at the location 1602. The continuation time 1604 indicates the time of continued stay at the location 1602. The continuation time 1604 indicates the difference between the end point of one previous staying room and the end point of the next staying room. When the end point of the next staying room has not been sensed (i.e., the person is staying in one room), the continuation time indicates the time difference between the current time and the most-recent end point. The method of estimating the staying room will be described later.

In the abnormality determination 1605, there is stored an abnormality ID 1701 when abnormality is determined by determination using an abnormality determination table (see FIG. 17) as will be described later. In the contact ID 1606, there is stored the contact ID1611 (see FIG. 16B) executed when the monitoring subject is determined to have abnormality. In the contact date/time 1607, there is stored the date/time of performance of a contact corresponding to the contact ID 1606.

FIG. 16B shows an example of the contact content table 1610 stored in the monitoring person information storage unit 16. The contact content table 1610 includes contact ID1611 and content 1612 as constituent items. In the content 1612, the specific content and result of a contact made by monitoring personnel after the monitoring subject was determined to be abnormal are described. While not shown herein, in the monitoring person information storage unit 16, there is also stored a management table storing monitoring personnel information (such as an account and a mail address) separately from the contact content table 1610.

FIG. 17 shows an example of an abnormality determination table 1700 stored in the abnormality determination information storage unit 11. The abnormality determination table 1700 includes abnormality ID 1701, meaning 1702, condition 1703, and emergency 1704 as constituent items.

The abnormality determination table 1700 stores information for determining abnormality of the monitoring subject, including the chronological change in the position of the monitoring subject and the walking parameters, such as walking sound intensity, walking period, walking position, and walking speed, as determination conditions. The chronological change in the position of the monitoring subject may include movement in the facility 1 (going back and forth in a specific location such as the hallway), the staying room in the facility 1, and staying time.

The meaning of the condition 1703 is indicated in the meaning 1702. For example, in the case of the abnormality ID 1701=U1, the condition 1703 that the person goes to the toilet room at night three times or more is set. This means that the toilet room is used frequently at night and that there is possible poor physical condition. In the case of the abnormality ID 1701=U2, the condition 1703 that the walking speed is less than 0.8 m/s is set. This means that there is a decrease in walking function. With regard to the condition 1703 in the abnormality determination table 1700, the reference for the walking function such as walking speed is set in accordance with the current walking function of the individual. For example, the walking speed is measured in a physical fitness test at the facility, and a certain ratio, such as 70%, of the speed is set as the reference. If the physical fitness test result cannot be obtained, a walking speed that is determined to be weak or a faster speed than that weak walking speed may be set as the reference. In order to sense a poor physical condition or injury, abnormality may be determined when the speed is equal to or less than a certain ratio, such as 50%, of an average value of walking speeds over a certain period in the past, such as a month. Thus, while not shown in FIG. 17, the condition 1703 may be each set for a plurality of monitoring subjects.

While not shown in FIG. 17, in the case of the condition 1703 for the abnormality ID 1701=U5 and U9, conditions corresponding to the walking signal intensity and walking period patterns that have been described with reference to FIG. 14B to FIG. 14E are set. Using the signal intensity and walking period patterns, the control unit/operating unit 13 of the information processing system 2 can determine the abnormality in the monitoring subject.

In the emergency 1704, an emergency indicating flag (0 or 1) is stored. For example, when the emergency 1704 is 1, emergency abnormality is indicated. In the case of emergency abnormality, the mail server 17 of the information processing system 2 notifies the emergency response personnel via electronic mail and the like. When the emergency level is low, such as when the walking function has gradually decreased due to aging, resulting in a decrease in walking speed, the normal-time monitoring person may contact the person when becoming aware, and may take a response to increase his or her walking function after confirming the will of the person, for example. When the staying time in the bathroom or toilet room is very long, there is the possibility of life-threatening emergency. Thus, the information processing system 2 performs a notification process with respect to emergency response personnel in addition to the normal-time monitoring personnel. In this case, the emergency response personnel may take an action of immediately visiting the monitoring subject, for example.

The flow of the process involving the abnormality determination table 1700 is as follows. The control unit/operating unit 13 of the information processing system 2, using the abnormality determination table 1700, the staying room estimation result, and the walking parameters, performs a determination process concerning the abnormality of the monitoring subject (step 915 of FIG. 9). The control unit/operating unit 13 performs computations to determine whether the state information table 1600 and the walking parameters match the determination condition of the condition 1703 in the abnormality determination table 1700. If there is the matching determination condition, the control unit/operating unit 13 writes the corresponding abnormality ID 1701 in the abnormality determination 1605 in the state information table 1600.

The information processing system 2 performs the notification process with respect to at least one of the normal-time monitoring personnel and the emergency response personnel in accordance with the emergency 1704 in the abnormality determination table 1700. In the case of emergency, the emergency response personnel makes an emergency visit to the facility 1 of the monitoring subject. The normal-time monitoring personnel confirms the abnormality of the monitoring subject via the terminal 3. Upon making a contact with the monitoring subject, the monitoring personnel inputs the contact content using the terminal 3. The control unit/operating unit 13 of the information processing system 2 receives the information, and records the contact ID 1606 and the contact date/time 1607 of the state information table 1600.

<Staying Room Estimation Method>

A method of estimating the staying room will be described. The control unit/operating unit 13 of the information processing system 2, using the chronological change in the position of the monitoring subject and the layout table 1500, determines the room in the facility 1 in which the monitoring subject is staying. For example, the control unit/operating unit 13, after receiving the chronological information of the resident's position (FIG. 8), determines the start point and the end point of a series of walking actions. The end of the walking actions is determined by taking the last step that has been sensed after the absence of sensing of the walking actions for a certain time as the end point.

The control unit/operating unit 13 refers to the layout table 1500 with respect to the position information of the end point. Herein, the layout ID 1501 such that the end point position is greater than the position determination minimum value 1504 and smaller than the position determination maximum value 1505 is determined. The control unit/operating unit 13 determines the layout ID 1501 as that of the room in which the subject is staying at the end of the walking actions. The staying room determination result is reflected in the state information table 1600. If the staying room is the entrance (i.e., if the end point of the walking actions is the entrance), the subject is considered to have gone outside.

As a method of more reliably determining the entry into and exit from a room, the door opening/closing sound or an atmospheric pressure change due to the door opening or closing may be measured as will be described below, and compared with the walking signal. So far, the staying room has been estimated at the end point of a series of walking actions; in addition, the start point may be determined. The start determination may be made by regarding the first step that has been sensed after the absence of sensing of the walking actions for certain time as the start point. By sensing the start point corresponding to the action of leaving the room in addition to the end point corresponding to the action of entering the room, the behavior of the monitoring subject can be learned in greater detail. When the subject becomes unable to move in the hallway, abnormality determination may be made by using both the start point and the end point.

A signal may be generated by hitting the floor in front of the entrance/exit of each room so that the information processing system 2 can perform computations for estimating the staying room and correct the computation expression as needed.

<Flow of Monitoring Service>

Figure 18:
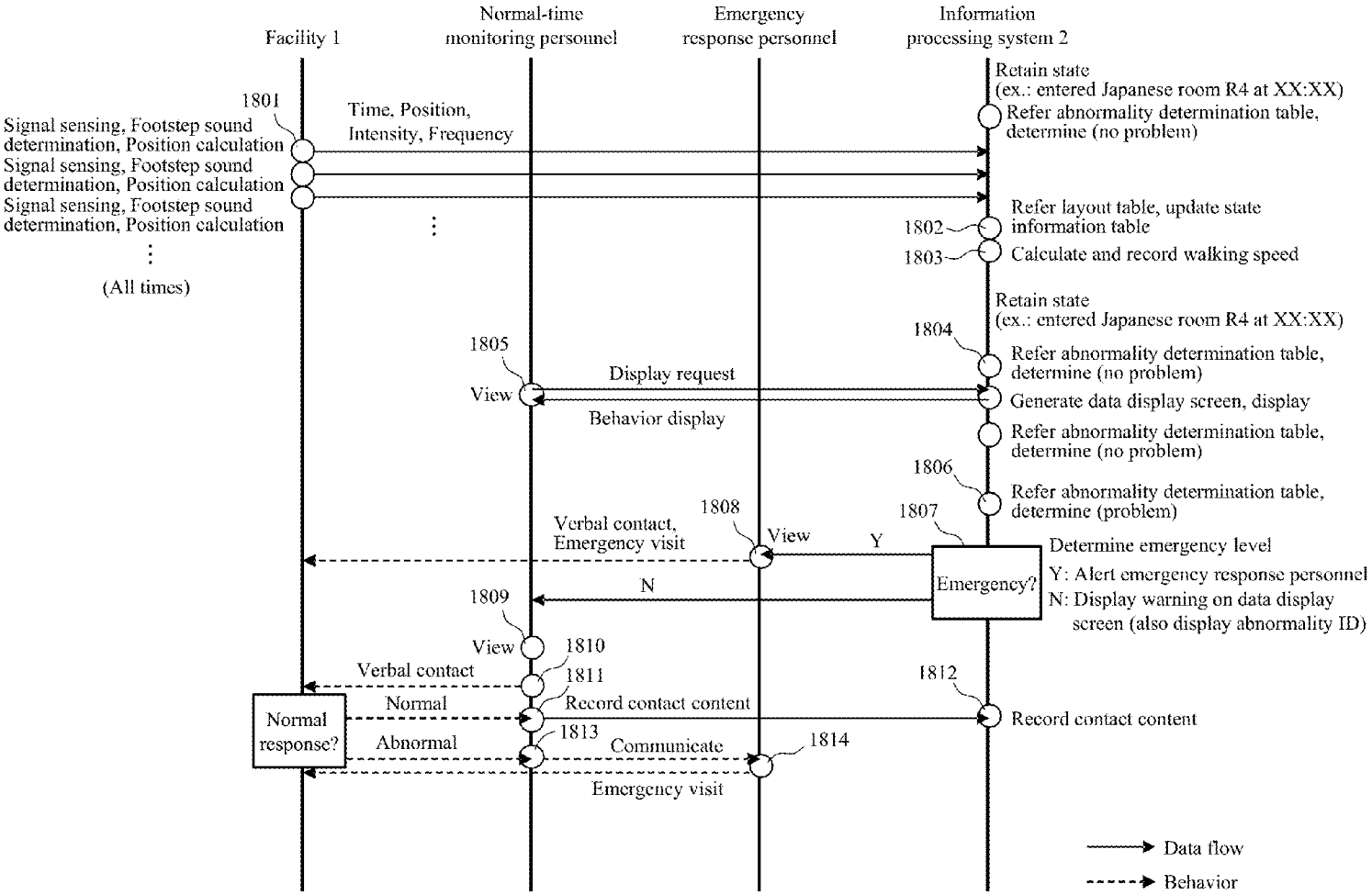
FIG. 18 shows an example of the flow of a monitoring service using the monitoring system of the first embodiment.

A process flow of the monitoring system will be described. FIG. 18 shows an example of the flow of a monitoring service using the monitoring system according to the first embodiment.

First, in response to an application for the monitoring service from the subject person, a family member, or a municipality that wishes to implement monitoring, the monitoring service provider installs the measuring system TN0200 in the facility 1 in which the monitoring subject lives. After the measuring system TN0200 is installed, sound may be generated at the entrance/exit and the like of each room as described above so as to correct the computation expression of the information processing system 2. Further, account registration is made in the information processing system 2. The monitoring service provider also determines normal-time monitoring personnel and emergency response personnel. The information about the normal-time monitoring personnel and the emergency response personnel (such as their accounts and addresses) is stored in the monitoring person information storage unit 16.

The monitoring personnel receives the account information for login, and then starts monitoring. The normal-time monitoring personnel monitors the data of the monitoring subject using the terminal 3, such as a PC or a portable terminal, at least once a day. In the following, the flow of notification of the monitoring personnel and the emergency response personnel will be described.

First, the measuring system TN0200 of the facility 1 constantly performs the sensing of sound signal, the determination of footstep sound, and the position computing process. The measuring system TN0200 of the facility 1 constantly transmits information about the times, the position of the monitoring subject, the footstep sound signal intensity, the footstep sound signal frequency and the like to the information processing system 2 (1801).

The information processing system 2, on the basis of the received information, performs the processes of calculating the walking period and estimating the staying room. Herein, the information processing system 2 refers to the layout table 1500 (FIG. 15) to update the state information table 1600 (1802).

Thereafter, the information processing system 2 calculates the walking parameters such as the walking speed, and records the calculated walking parameters in the history accumulation unit 12, for example (1803). The information processing system 2 determines whether the information of the state information table 1600 and the walking parameters satisfy the condition of the abnormality determination table 1700 (1804). Herein, it is assumed that it has been determined that the monitoring subject has no abnormality (1804).

The normal-time monitoring personnel, using the terminal 3, sends a request to the information processing system 2 for displaying the data display screen, and then the data display screen (see FIG. 19) is displayed on the terminal 3 (1805). As no abnormality is recognized in the monitoring subject, the normal-time monitoring personnel does not take any action.

The information processing system 2 then determines whether the information of the state information table 1600 and the walking parameters satisfy the condition of the abnormality determination table 1700, and it is determined that the monitoring subject has abnormality (1806).

Herein, the information processing system 2 refers to the emergency 1704 of the abnormality determination table 1700 and determines whether the abnormality has high emergency level (1807). If it is determined that the abnormality has high emergency level, the information processing system 2 directly notifies the terminal 3 of the emergency response personnel ("Y" in 1807). The emergency response personnel views the notification from the information processing system 2, and verbally contacts the monitoring subject or makes an emergency visit to the facility 1 (1808).

On the other hand, if the abnormality is not an emergency, the information processing system 2 notifies the terminal 3 of the normal-time monitoring personnel ("N" in 1807). The monitoring personnel views the notification from the information processing system 2 (1809), and contacts the monitoring subject (verbally, for example) (1810). If the monitoring subject makes a normal response, the monitoring personnel inputs the content of the contact using the terminal 3 (1811). The information processing system 2 then records the received contact content in the state information table 1600 (1812). If the monitoring subject responds with a report of abnormality, the monitoring personnel makes contact with the emergency response personnel (1813). In response, the emergency response personnel makes an emergency visit to the facility 1 (1814).

When abnormality is recognized and a decrease in walking function with a low emergency level is suspected, for example, a recommendation for a function recovery/reinforcement service, such as training, is made. If the monitoring subject so desires, the monitoring service provider contacts a function recovery/reinforcement service provider.

The above operation can be carried out without requiring special skills from the normal-time monitoring personnel, and without the need to make constant verbal contact with the monitoring subject or to make an emergency visit to the facility 1. Thus, the monitoring system according to the present embodiment does not put much burden on the normal-time monitoring personnel. By utilizing the monitoring system, a family member in the neighborhood may become the monitoring personnel. As a result, compared with the case where the monitoring system is provided with a dedicated employee, the monitoring service can be provided at low cost.

<Example of Terminal Screen>

Figure 19:
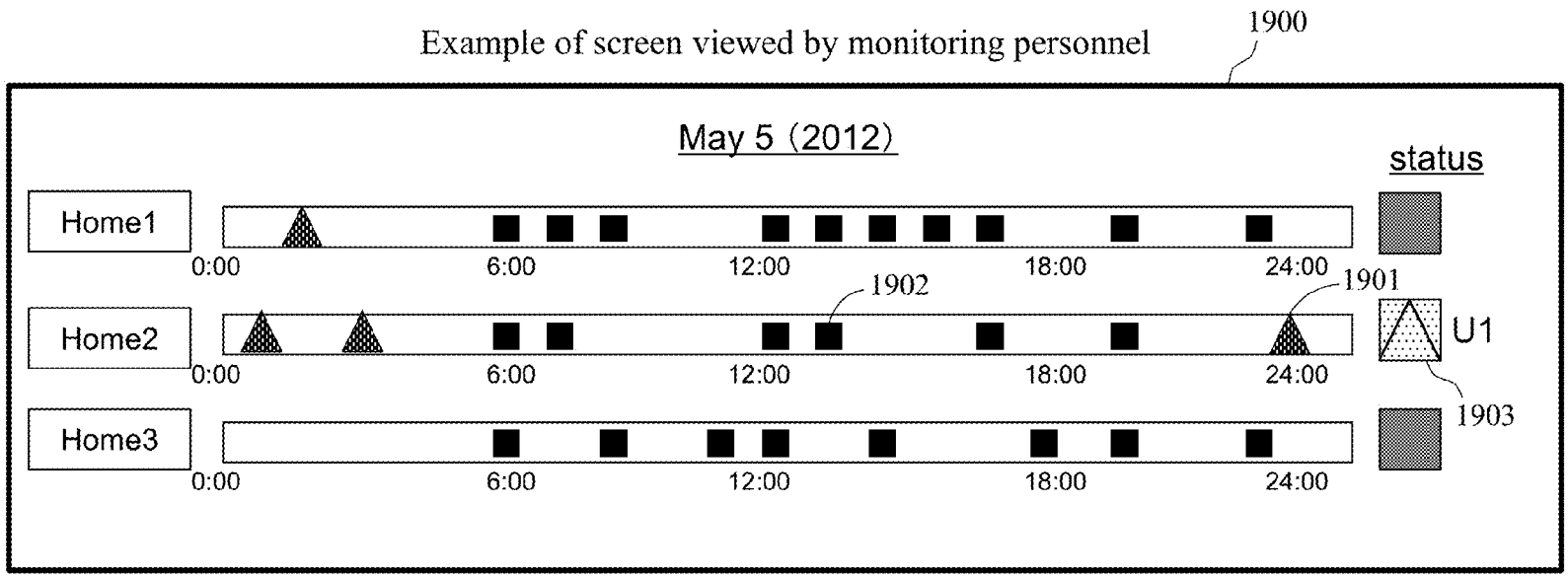
FIG. 19 shows an example of a data display screen provided by the information processing system for monitoring personnel.

FIG. 19 illustrates an example of the data display screen provided by the information processing system 2 for the monitoring personnel, the screen being displayed on the terminal 3.

A screen 1900 shows the behavior information of a plurality of monitoring subjects and the presence or absence of abnormality in list form. Thus, the monitoring personnel can efficiently monitor the plurality of monitoring subjects. Herein, the screen 1900 displays the information of the monitoring subjects at three locations including Home 1, Home 2, and Home 3.

For example, a triangular mark 1901 indicates passage through the hallway at night, and a rectangular mark 1902 indicates passage through the hallway during the daytime. The monitoring subject in Home 2 awoke three times at night and passed the hallway. In this case, the monitoring subject awoke three times at night and went to the toilet room, which falls under U1 in the abnormality ID 1701 of the abnormality determination table 1700. Thus, a warning is displayed in status 1903, while at the same time the abnormality ID 1701 (U1) is displayed.

When abnormality, such as a large number of times of awaking at night or a decrease in walking speed, is being displayed on the screen 1900, the monitoring personnel contacts the monitoring subject by telephone and the like. If in fact no abnormality is recognized, the monitoring personnel inputs the contact content using the terminal 3. The information processing system 2, upon reception of the information about the contact content from the terminal 3, records the information in the contact ID 1606 and the contact date/time 1607 of the state information table 1600.

According to the present embodiment, the position of the monitoring subject can be chronologically measured and monitored in everyday life without the monitoring subject becoming particularly aware. The motor function of the monitoring subject can also be chronologically measured and monitored. The result of sensing is compared with a predetermined determination condition, whereby the abnormality of the monitoring subject can be sensed. Thus, on the basis of the sensing result, an appropriate measure can be taken externally with respect to the monitoring subject.

Further, according to the present embodiment, by comparing the learned position information and the previously acquired room layout information, behavior monitoring of when and which room the monitoring subject entered or left can be performed. Thus, a change in the daily life pattern of the monitoring subject can also be learned, whereby a disorder in the monitoring subject can be sensed from an increased number of pieces of information.

According to the present embodiment, by monitoring the walking function of the monitoring subject in his or her everyday life, signs of deterioration in motor function, such as walking function, can be captured and then a preventive action can be taken.

Second Embodiment

Figure 20:
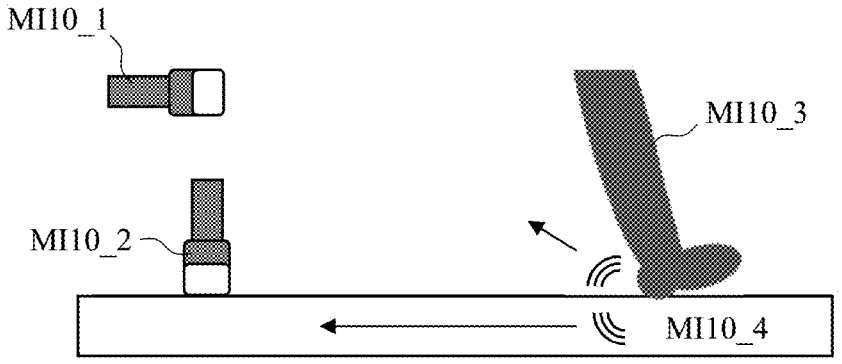
FIG. 20 shows a schematic view illustrating the principle of a position estimation method in the monitoring system according to a second embodiment.

In the present embodiment, another example of the method of estimating the position of the monitoring subject in the facility 1 will be described. FIG. 20 shows a schematic view illustrating the principle of the position estimation method according to the second embodiment.

In the position estimation method according to the present embodiment, the difference in sound propagation speed depending on the type of medium is utilized. The walking sound generated when a leg MI10_3 lands on a floor MI10_4 during walking is measured using two microphones including an atmospheric sound microphone MI10_1 and a floor sound microphone MI10_2. The atmospheric sound microphone MI10_1 and the floor sound microphone MI10_2 are installed at mutually proximate positions. The atmospheric sound microphone MI10-1 observes sound transmitted through the air, while the floor sound microphone MI10-2 observes sound transmitted through the floor.

Figure 21:
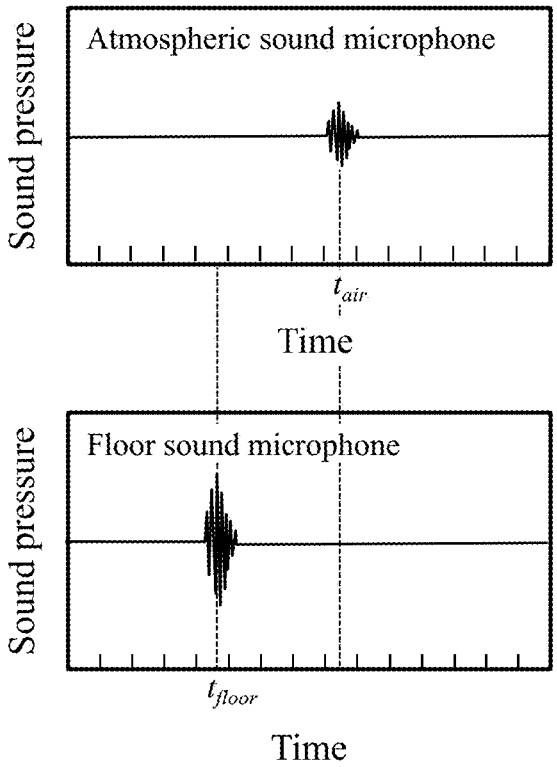
FIG. 21 illustrates the result of an experiment comparing signals measured from the same signal source via two different media.

The propagation speed of sound greatly varies depending on the type of transmitting medium. For example, the speed of sound transmitted in the air is approximately 350 meters per second. Meanwhile, the propagation speed in wood, which is often used as floor material, is on the order of 3000 to 5000 meters per second. FIG. 21 illustrates the time at which certain walking sound reaches the atmospheric sound microphone MI10_1 and the floor sound microphone MI10_2. As illustrated in FIG. 21, in the case of the atmospheric sound microphone MI10_1, the walking sound arrival time is $t_{air}$, whereas in the case of the floor sound microphone MI10_2, the walking sound arrival time is $t_{floor}$. Thus, the arrival time for the floor sound microphone MI10_2 is earlier than that for the atmospheric sound microphone MI10_1. This difference in arrival time is analyzed to calculate a distance 1 of the walking sound source from the microphones according to the following expression.

$$l = \frac{v_{air} \times v_{floor} \times (t_{air} - t_{floor})}{v_{floor} - v_{air}}$$

wherein $v_{air}$ and $v_{floor}$ are the propagation speed of sound in the atmosphere and the floor material, respectively. These values are dependent on the building and the layout used, and may be used as constants if once determined by actual measurement. Thus, the distance 1 of the walking sound source from the microphones is proportional to the difference between the time at which the walking sound was observed by the atmospheric sound microphone MI10_1 and the time at which the sound was observed by the floor sound microphone MI10_2. Further, on the basis of the distance 1 of the walking sound from the microphones and the information about the layout of microphone installation, the position of the monitoring subject is estimated.

Figure 22A:
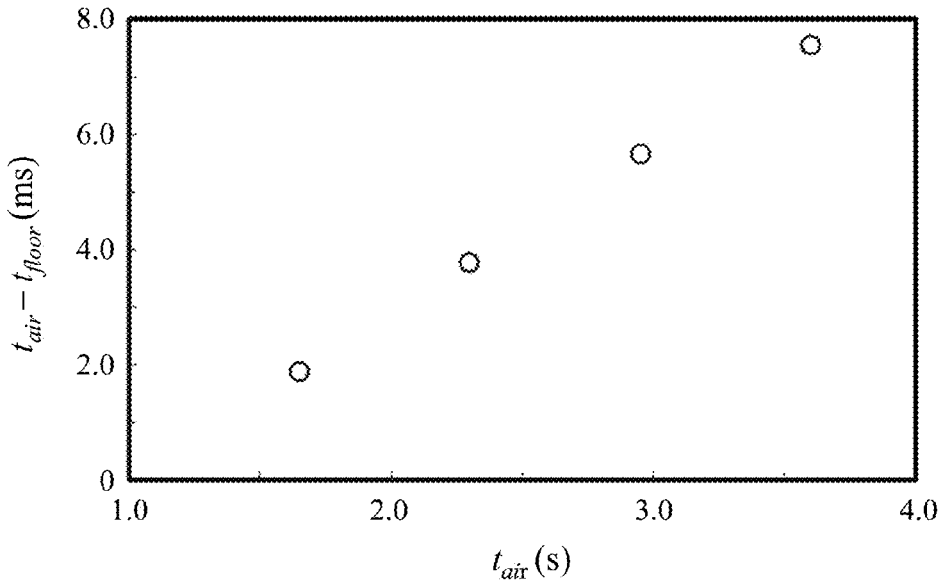
FIG. 22A shows a plot of an arrival time difference between signals measured from the same signal source via two different media.
Figure 22B:
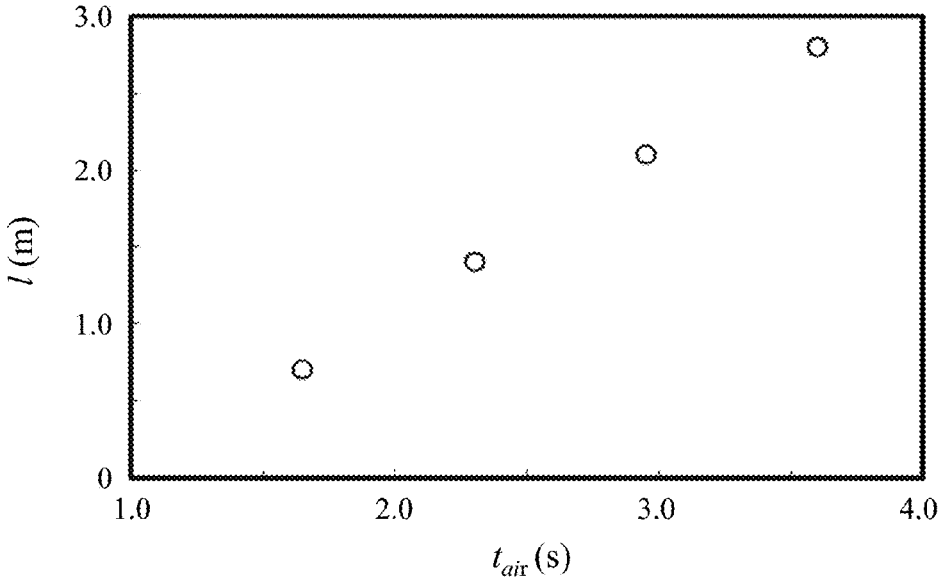
FIG. 22B shows a plot of a signal source position estimated from the arrival time difference of FIG. 22A.

A specific example of the position estimation method in a case where the monitoring subject walks and moves in the hallway will be described. When the monitoring subject walked and moved in the hallway of approximately 3 m, walking sound was observed four times by the atmospheric sound microphone MI10_1 and the floor sound microphone MI10_2 installed at the ends of the hallway. FIG. 22A shows a plot, with respect to the walking sound, of the difference between the arrival time by the atmospheric sound microphone MI10_1 and the arrival time by the floor sound microphone MI10_2 with respect to the arrival time $t_{air}$ at the atmospheric sound microphone MI10_1. FIG. 22B shows a plot of the distance 1 from the microphone calculated from the difference between the arrival time of the walking sound by the atmospheric sound microphone MI10_1 and the arrival time by the floor sound microphone MI10_2 according to the above expression, where $v_{air}$ and $v_{floor}$ were 340 meters per second and 4200 meters per second, respectively, with respect to the arrival time $t_{air}$ at the atmospheric sound microphone MI10_1.

In this way, the distance of the walking sound source, i.e., the monitoring subject, from the microphones at the respective times at which the walking sound was produced can be obtained. On the basis of the distance 1 of the walking sound source from the microphones and the layout information of the installed microphones, the position of the monitoring subject can be estimated.

According to the present embodiment, the walking sound transmitted in the medium of the atmosphere and the walking sound transmitted in the medium of the floor are measured separately using two microphones. When a non-directional microphone is installed a few millimeters to a few centimeters above the floor, both the floor sound and the atmospheric sound can be measured. While according to the present embodiment the microphones are used to detect the walking sound, it is also possible to use other vibration detection devices, such as an acceleration sensor, a piezo sensor, or a distortion sensor.

Third Embodiment

In the present embodiment, a method of estimating the position of the monitoring subject in the building when the walking sound is so small that it is difficult to observe the walking sound as vibrations will be described.

When the walking sound cannot be observed even though the monitoring subject is moving, debilitation of the monitoring subject can be suspected. Thus, it is desirable to be able to detect the debilitation using the monitoring system for monitoring health state. However, if the walking sound cannot be observed, the location of the monitoring subject cannot be identified by the above-described method, and it cannot be detected whether the subject is moving. In this case, in order to identify the location of the monitoring subject, not only the walking sound information but also another position detection method may be used.

For that purpose, one method employs distance sensors that utilize reflection of electromagnetic waves, such as ultrasonic waves or infrared ray, from an observed object. The distance sensors detect electromagnetic waves reflected from the observed object, and calculates the distance between the observed object and the sensors by utilizing a shift from an expected arrival time or the method of triangulation. By installing the distance sensors at positions on the ceiling overlooking the line of daily movement in the hallway, for example, and measuring the monitoring subject, the location of the monitoring subject can be estimated. This method can be readily implemented using inexpensive sensors. However, because it needs to be ensured that the monitoring subject will be irradiated with the electromagnetic waves and the reflected wave will return to the sensors without fail, the installed location needs to be carefully considered in light of the building environment involved.

In another example, an infrared ray 360°-camera (image acquisition unit) may be installed at a ceiling position overlooking the line of daily movement in the hallway and the like, and the position of the monitoring subject may be calculated on the basis of an infrared ray image. This method affords a certain degree of freedom in installed location. However, the information processing system 2 needs to be provided with an image data processing unit for position detection from the image.

In yet another method, electrostatic proximity sensors may be installed in stripes or a lattice on the back of the floor under the line of daily movement in the hallway, for example. The electrostatic proximity sensors are sensors used for electrostatic capacitance type touch panels for sensing a change in electric capacity between an electrode and an object which can be considered the electric ground. As the object comes closer to the electrode, the electric capacity increases, indicating that the object is approaching the electrode. By installing the sensors in stripes at 15 cm intervals in the longitudinal direction of the hallway, for example, the position of the monitoring subject can be observed with 15 cm resolution. The method has the advantage in that the proximity sensors can be installed on the back of the floor board, for example, and that, once installed, not much running cost is required. However, it is necessary to install the sensors on the back of the floor boards, or to lay a covering, such as a carpet or mattress, with the electrostatic proximity sensors attached in stripes on the floor.

Fourth Embodiment

Figure 23:
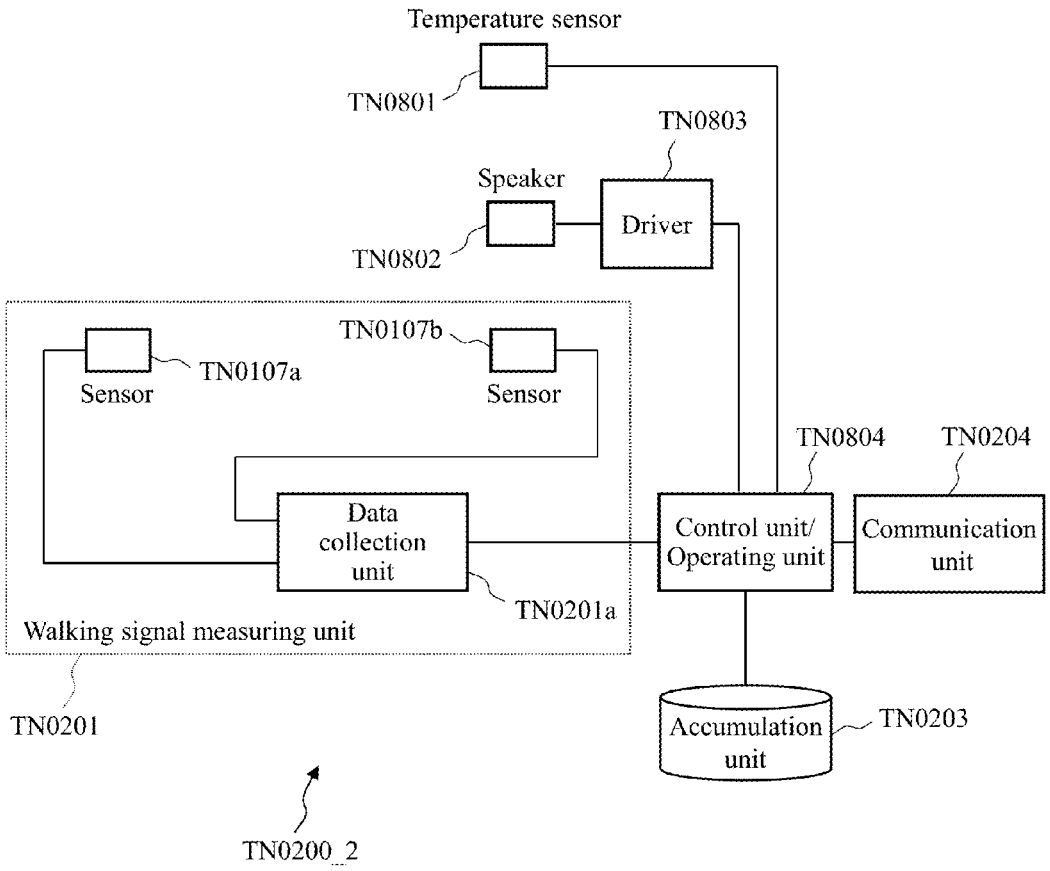
FIG. 23 shows a configuration diagram of a measuring system in the monitoring system according to a fourth embodiment.

In the present embodiment, a method and a configuration for parameter calibration during calculation of the sound source position will be described. FIG. 23 shows a configuration diagram of the monitoring system according to the fourth embodiment, illustrating another example of the measuring system installed in the facility 1.

A measuring system TN0200_2 is provided with the sensors TN0107*a* and TN0107*b*, the data collection unit TN0201*a*, a control unit/operating unit TN0804, the accumulation unit TN0203, the communication unit TN0204, a temperature sensor TN0801, a speaker TN0802, and a driver TN0803. The speaker TN0802 outputs a signal of the same kind as a footstep sound signal from the monitoring subject, for example.

When the sound source position is calculated, the distance between the sensors TN0107*a* and TN0107*b*, and the propagation speed of sound are used as parameters. The sensors TN0107 installed in the facility 1 may be moved when the location of furniture and the like is changed. When the sensors TN0107 are initially installed, for example, calibration is necessary to measure the distance between the sensors. Further, because the propagation speed of sound varies depending on temperature, correction is necessary depending on the current atmospheric temperature. Thus, in the following example, the temperature sensed by the temperature sensor TN0801 and the arrival time difference of the signal from the speaker TN0802 between the sensors TN0107*a* and TN0107*b* are used to calibrate the expression for estimating the sound source position of the footstep sound.

Figure 24:
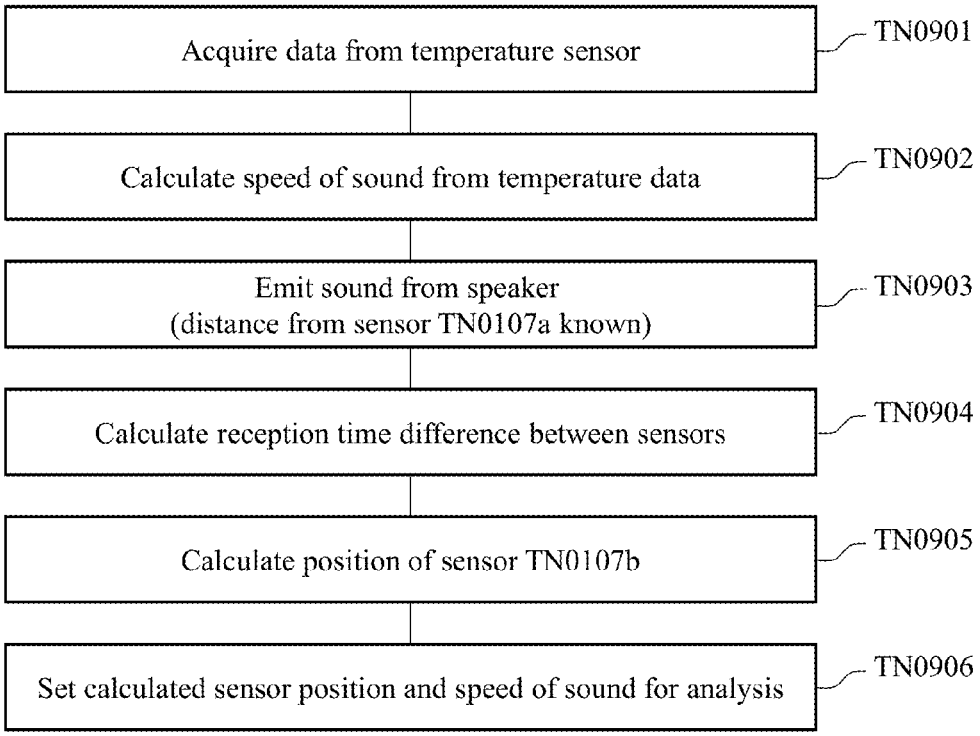
FIG. 24 shows the flow of a calibration operation in the measuring system of the fourth embodiment.

FIG. 24 shows the flow of calibration. First, the control unit/operating unit TN0804 controls the temperature sensor TN0801 and acquires atmospheric temperature data (TN0901). The propagation speed of sound in air, which is known to vary depending on the atmospheric temperature, can be approximately calculated according to the following expression, for example.

$$v_s=331.5+0.6T \text{ (m/s)}$$

where T is the atmospheric temperature (° C.). The control unit/operating unit TN0804 determines the propagation speed of sound $v_s$ from the atmospheric temperature according to the expression (TN0902).

The distance between the two sensors TN0107*a* and TN0107*b* is calibrated using the sound from the speaker TN0802 installed at a predetermined distance from the sensors TN0107*a* (the distances between the sensors TN0107*a* and the speaker TN0802 are supposed to be known). The speaker TN0802 is driven by the driver TN0803 to output sound (TN0903).

The sound output from the speaker TN0802 is received by the sensors TN0107. The control unit/operating unit TN0804 calculates the reception time difference between the sensors TN0107*a* and TN0107*b* (TN0904).

Because the distances between the speaker TN0802 as the sound source and the sensors TN0107*a* are known, the control unit/operating unit TN0804 computes the position of the sensor TN0107*b* (TN0905). For the computation, the propagation speed of sound calculated from the data measured by the temperature sensor TN0801 is used. The control unit/operating unit TN0804 sets the parameters determined as described above for analysis (TN0906), and use them for analysis for the calculation of the sound source position.

The sound output from the speaker TN0802 during calibration does not need to be in the audible range, and may be ultrasonic waves, for example. Ultrasonic waves are inaudible to humans, so that calibration can be performed without being recognized by the residents. In order to prevent the calibration from arousing a sense of discomfort, music may be employed.

The calibration may be performed regularly, at the start of the monitoring system, or upon generation of an event, for example. Specifically, by performing the calibration at the start of power supply following installation of the sensors TN0107 and the like, the parameters for position computation can be obtained automatically. By performing the calibration regularly, such as at 10 minute intervals, atmospheric temperature changes in the day can be addressed. The calibration may be implemented when the atmospheric temperature is changed, or when a large sound or an event producing sounds associated with movement of furniture or the sensors TN0107 themselves is produced. Alternatively, calibration may be performed in accordance with an instruction from the information processing system 2 via the network 8. For example, when there is abnormality in the footstep sound position data and it is determined that parameter calibration is required, an instruction may be issued from the information processing system 2. Calibration may also be performed when the monitoring subject is outside.

While the calibration in the present embodiment has been described with reference to the configuration including the newly provided speaker TN0802, this is not a limitation, and a sound source with a known location may be used instead of the speaker TN0802. For example, calibration may be performed using the opening/closing sound of a door of which the position is known from the layout. In this way, calibration can be performed on a daily basis without particularly installing the speaker TN0802 or the like.

Figure 25:
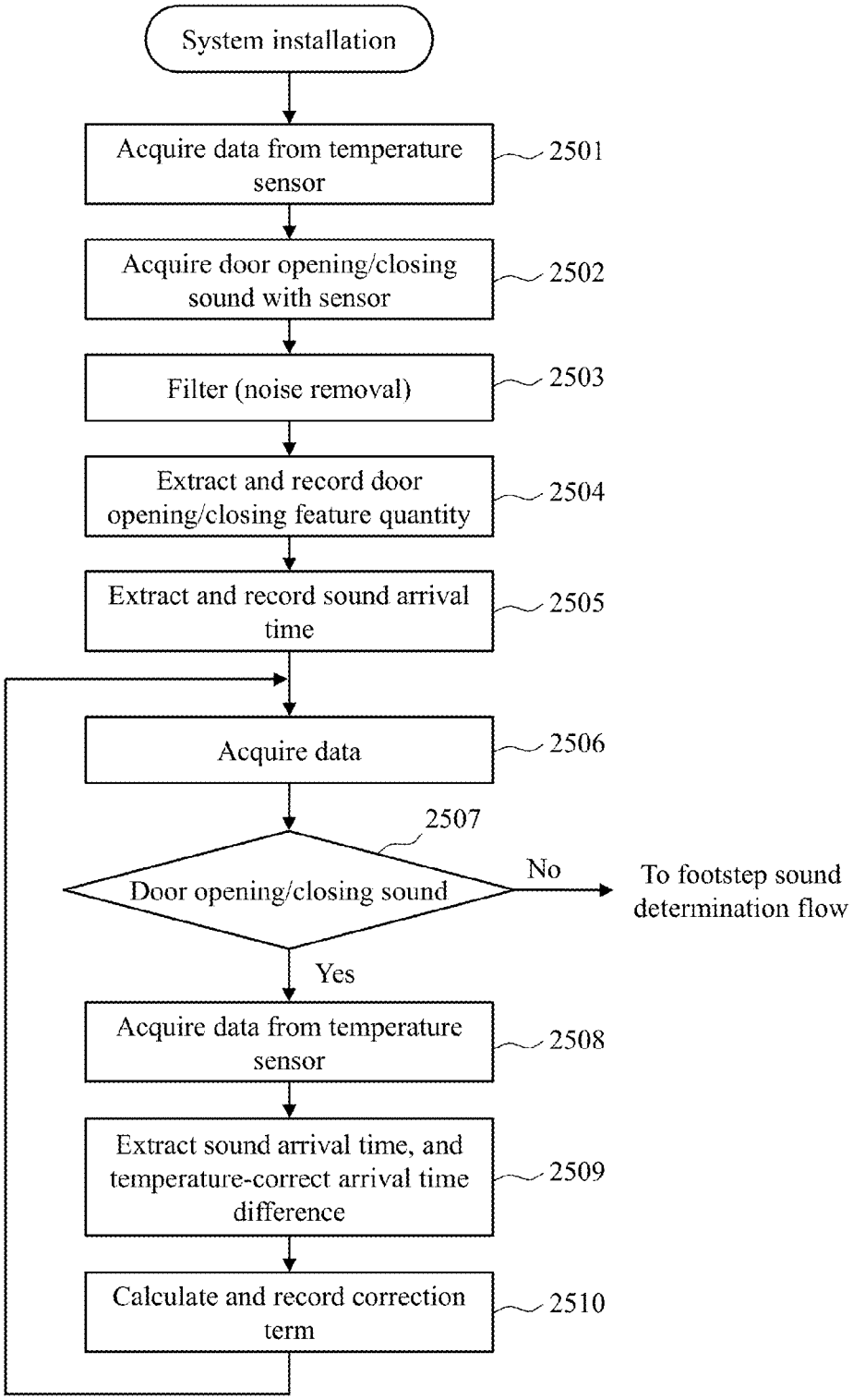
FIG. 25 shows the flow in a case where door opening/closing sound is utilized for calibration function.

FIG. 25 shows the flow in the case where the door opening/closing sound is used for calibration. In the following description, reference will be made to the signs in FIG. 23. However, the measuring system TN0200_2 in the present example does not include the speaker TN0802 and the driver TN0803, and it is assumed that the distances between the sensors TN0107 and the door for calibration are known.

When the door opening/closing sound is utilized for calibration, in order to discriminate the opening/closing sound of the door of the facility 1 or a residence in which the measuring system TN0200_2 is installed, a procedure for acquiring and recording the opening/closing sound of the door is required, besides the normal calibration procedure. For example, the measuring system TN0200_2 is provided with a calibration table for recording data of changes over time in the parameters (such as a frequency region and an intensity) characterizing the door opening/closing sound, and the data from the temperature sensor TN0801. In the following, the flow of the process will be described.

First, after the measuring system TN0200_2 is installed in the facility 1, the control unit/operating unit TN0804 controls the temperature sensor TN0801 and acquires the atmospheric temperature data (2501). The door opening/closing sound is acquired by the sensors TN0107*a* and TN0107*b* (2502). Thereafter, the control unit/operating unit TN0804 subjects the acquired data to filtering process to remove noise (2503).

The control unit/operating unit TN0804 then extracts feature quantities (such as a frequency region and an intensity) of the door opening/closing sound, and records changes in the feature quantities over time and the data from the temperature sensor TN0801 in the calibration table (2504). The control unit/operating unit TN0804 also calculates a door opening/closing sound arrival time difference between the sensors TN0107*a* and TN0107*b* and records the information in the calibration table (2505).

Steps 2501 to 2505 are performed at the time of system installation. Thus, during calibration at the time of system installation, the changes over time in the frequency region and intensity characterizing the door opening/closing sound are acquired in advance, and the acquired data and the data from the temperature sensor TN0801 are recorded in the calibration table. In addition, a signal is received by the sensors TN0107*a* and TN0107*b*, and the arrival time difference is detected and recorded. When there is a plurality of doors, the feature quantities of the opening/closing sound and the reception time difference between the sensors TN0107*a* and TN0107*b* are recorded in pairs for each door. In this configuration, even when the sound feature quantities are similar, the position can be estimated on the basis of the time difference information, so that the doors can be distinguished. For calibration, the opening/closing sound of any of the doors may be used.

Steps 2507 to 2510 are everyday sound measurement steps. During everyday sound measurement, the control unit/operating unit TN0804 compares the signals detected by the sensors TN0107*a* and TN0107*b* with the values in the calibration table, and determines whether the sound is the door opening/closing sound (2507). If it is determined that the sound is not the door opening/closing sound, the process transitions to the above-described footstep sound determination flow without performing calibration.

If it is determined that the sound is the door opening/closing sound, the temperature sensor TN0801 is controlled to acquire atmospheric temperature data, as in the case of the above-described calibration (2508). Then, the control unit/operating unit TN0804, on the basis of the data from the temperature sensor TN0801, determines a value Δtc' by temperature-correcting the arrival time difference of the door opening/closing sound received by the sensors TN0107*a* and TN0107*b* (2509).

The control unit/operating unit TN0804 then calculates a correction term of the expression for determining the sound source position of the footstep sound, and records the correction term (2510). Herein, the arrival time difference of the door opening/closing sound received by the same sensors TN0107*a* and TN0107*b* at the time of system installation is Δtc. When the arrival time difference Δtc' is different from the arrival time difference Δtc, it is considered that the sensor positions have shifted. When the footstep sound is sensed, if the reception time difference between the sensors TN0107*a* and TN0107*b* is Δt, the expression for determining the sound source position xf of the footstep sound is the expression $x_f(n)$ indicated in the first embodiment to which the correction term is added, as follows.

$$xf=\{\Delta t\cdot v_s+(x_2+x_1)\}/2+(\Delta tc-\Delta tc')/2$$

where the subscript n is omitted, and $x_1$ and $x_2$ are the coordinates of the sensors TN0107*a* and TN0107*b* at the time of the initial installation of the sensors. In this configuration, even when the sensors TN0107*a* and TN0107*b* have been moved after system installation, an accurate position can be measured by comparison with the previously recorded values in the calibration table and determining the correction term of the expression for determining the sound source position of the footstep sound.

The present invention is not limited to the foregoing embodiments, and may include various modifications. The embodiments have been described for facilitating an understanding of the present invention, and are not necessarily limited to include all of the configurations described. A part of the configuration of one embodiment may be substituted by the configuration of another embodiment, or the configuration of the other embodiment may be incorporated into the configuration of the one embodiment. With respect to a part of the configuration of each embodiment, addition of another configuration, deletion, or substitution may be made.

For example, as described above, the data from the sensors TN0107 may be directly transmitted to the information processing system 2, and the rest of the processes may be performed on the part of the information processing system 2. Information for abnormality determination and the like may be located in the facility 1 so that the processes up to abnormality determination can be performed on the part of the measuring system TN0200. Thus, the configuration of the respective bases may be modified as needed.

As described above, the configuration of an embodiment may be partly or entirely realized in hardware by using integrated circuit design. The present invention may be realized in the form of a software program code for realizing the functions of an embodiment. In this case, a non-transitory computer-readable medium (non-transitory computer-readable medium) having the program code recorded therein may be provided to an information processing device (computer), and the information processing device (or a CPU) may read the program stored in the non-transitory computer-readable medium. Examples of the non-transitory computer-readable medium include a flexible disc, a CD-ROM, a DVD-ROM, a hard disk, an optical disk, a magnetooptical disk, a CD-R, a magnetic tape, a non-volatile memory card, and a ROM.

The program code may be supplied to the information processing device via various types of transitory computer-readable media. Examples of the transitory computer-readable media include an electric signal, an optical signal, and an electromagnetic wave. The transitory computer-readable medium can supply the program to the information processing device via a wired communication channel, such as an electric wire or an optical fiber, or a wireless communication channel.

The control lines or information lines depicted in the drawings are only those considered necessary for description, and do not necessarily indicate all control lines or information lines required in a product. All of the configurations may be mutually connected.

REFERENCE SIGNS LIST

1 Facility
2 Information processing system (information processing unit)
3 Terminal
8 Network
9 Communication unit
10 Layout information storage unit
11 Abnormality determination information storage unit
12 History accumulation unit
13 Control unit/operating unit
14 Application server
15 WEB server
16 Monitoring person information storage unit
17 Mail server
100 Monitoring system
1500 Layout table (layout information)
1600 State information table
1610 Contact content table
1700 Abnormality determination table
TN0200 Measuring system (measuring unit)
TN0201 Walking signal measuring unit
TN0201*a* Data collection unit
TN0202 Control unit/operating unit
TN0203 Accumulation unit
TN0204 Communication unit

The invention claimed is:

1. A system for monitoring a health state of a subject, the system comprising:

a measuring unit that chronologically measures a position of the subject in a facility in which the subject resides or stays;

the measuring unit includes a plurality of sensors that sense a sound or a vibration from the subject;

the measuring unit estimates a position of the subject by using a time difference in an arrival of a signal to the plurality of sensors from the subject; and an information processing unit that determines the health state of the subject by determining whether a chronological change in the position of the subject satisfy a predetermined determination condition.

2. The system according to claim 1, wherein:

the plurality of sensors are installed at proximate positions in the facility, and sense signals propagating in mutually different media; and the measuring unit estimates the position of the subject by using a propagation speed difference of the signals in the different media.

3. The system according to claim 1, wherein the measuring unit estimates the position of the subject by using at least one of a sensor for sensing reflection of an electromagnetic wave from the subject, an image acquisition unit for sensing a position from an image including the subject, and a sensor for sensing a change in electric capacity when the subject approaches.

4. The system according to claim 1, wherein:

the measuring unit includes a temperature sensor that senses a temperature in the facility, and a sound output part installed at a predetermined distance from the plurality of sensors; and the measuring unit performs calibration of an expression for estimating the position of the subject by using the temperature sensed by the temperature sensor and the time difference in the arrival of the signal to the plurality of sensors from the sound output part.

5. The system according to claim 4, wherein the sound output part is a speaker that outputs a signal of a same kind as a signal of the sound from the subject.

6. The system according to claim 4, wherein:

the sound output part is a door in the facility; and the measuring unit performs the calibration by using calibration information in which data characterizing a sound from the door and data from the temperature sensor are recorded.

7. The system according to claim 1, wherein:

the information processing unit calculates at least one of a walking speed and a walking period of the subject from a chronological change in the position of the subject; and the determination condition includes a condition concerning at least one of the walking speed and the walking period.

8. The system according to claim 1, wherein:

the measuring unit includes a plurality of sensors that sense a sound or a vibration from the subject; and the measuring unit determines a walking sound of the subject by using chronological data of a signal intensity of a signal sensed by the plurality of sensors.

9. The system according to claim 8, wherein:

the measuring unit determines the walking sound of the subject by determining whether a peak signal of the chronological data satisfies a predetermined walking discriminating condition; and the walking discriminating condition includes a condition concerning at least one of an intensity range in a predetermined frequency region with respect to the peak signal, and a decay time of the peak signal.

10. The system according to claim 9, wherein the measuring unit determines whether the subject is in walking state by determining whether a time difference between two successive peak signals determined to be the walking sound of the subject is within a predetermined time.

11. The system according to claim 8, wherein:

the information processing unit calculates an intensity of the walking sound of the subject and a walking period of the subject from a signal determined to be the walking sound of the subject; and the determination condition includes a condition concerning at least one of the walking sound intensity and the walking period.

12. The system according to claim 1, wherein:

the information processing unit includes a storage unit in which layout information of a room in the facility is stored; and the information processing unit determines, by using the chronological change in the position of the subject and the layout information, the room in the facility in which the subject is staying.

13. The system according to claim 12, wherein the determination condition includes a condition concerning at least one of movement in the facility, the staying room in the facility, and a staying time in the room in the facility.

14. The system according to claim 1, further comprising at least one terminal including a display unit that displays the state of the subject, wherein the information processing unit, when the health state of the subject is determined to be abnormal, performs a process of notifying the at least one terminal.

* * * * *